US010714254B2

(12) United States Patent
Nakatsuji et al.

(10) Patent No.: US 10,714,254 B2
(45) Date of Patent: Jul. 14, 2020

(54) ELECTRONIC COMPONENT

(71) Applicant: MURATA MANUFACTURING CO., LTD., Kyoto-fu (JP)

(72) Inventors: Yoichi Nakatsuji, Nagaokakyo (JP); Kosuke Ishida, Nagaokakyo (JP); Mizuho Katsuta, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 263 days.

(21) Appl. No.: 15/612,031

(22) Filed: Jun. 2, 2017

(65) Prior Publication Data

US 2018/0012698 A1 Jan. 11, 2018

(30) Foreign Application Priority Data

Jul. 6, 2016 (JP) ..... 2016-133797

(51) Int. Cl.
*H01F 5/00* (2006.01)
*H01F 27/28* (2006.01)
(Continued)

(52) U.S. Cl.
CPC ..... *H01F 27/2804* (2013.01); *H01F 17/0013* (2013.01); *H01F 27/292* (2013.01);
(Continued)

(58) Field of Classification Search
USPC ..... 336/200, 232, 192, 83
See application file for complete search history.

(56) References Cited

U.S. PATENT DOCUMENTS

2010/0052838 A1* 3/2010 Matsuta ..... H01F 17/0013 336/200
2013/0009740 A1* 1/2013 Chang ..... H01F 41/04 336/200
(Continued)

FOREIGN PATENT DOCUMENTS

CN 102637505 A 8/2012
CN 101667484 B 11/2012
(Continued)

OTHER PUBLICATIONS

An Office Action; "Notification of Reasons for Refusal," Mailed by the Japanese Patent Office dated Dec. 11, 2018, which corresponds to Japanese Patent Application No. 2016-133797 and is related to U.S. Appl. No. 15/612,031; with English language translation.
(Continued)

*Primary Examiner* — Elvin G Enad
*Assistant Examiner* — Kazi S Hossain
(74) *Attorney, Agent, or Firm* — Studebaker & Brackett PC

(57) ABSTRACT

An electronic component includes a body, a first inductor, and a low expansion portion. The body includes a laminated body including a plurality of insulating layers laminated in a lamination direction. The insulating layers contain a first resin as a material. The first inductor includes a first inductor conductor layer that adjoins one of the insulating layers. The low expansion portion has a coefficient of linear expansion lower than a coefficient of linear expansion of the plurality of insulating layers. The low expansion portion contains a second resin as a material. At least part of the low expansion portion is embedded in the laminated body. The second resin has a coefficient of linear expansion that is lower than a coefficient of linear expansion of the first resin.

24 Claims, 15 Drawing Sheets

(51) Int. Cl.

| | |
|---|---|
| ***H01F 17/00*** | (2006.01) |
| ***H01F 27/29*** | (2006.01) |
| ***H01F 27/32*** | (2006.01) |
| ***H01F 41/04*** | (2006.01) |
| *H01F 27/255* | (2006.01) |
| *H01F 27/30* | (2006.01) |

(52) U.S. Cl.
CPC ..... *H01F 27/323* (2013.01); *H01F 41/041* (2013.01); *H01F 27/255* (2013.01); *H01F 27/306* (2013.01); *H01F 2027/2809* (2013.01)

(56) References Cited

U.S. PATENT DOCUMENTS

| | | | | |
|---|---|---|---|---|
| 2015/0270055 | A1* | 9/2015 | Nakamura | H01F 5/00 336/200 |
| 2016/0225513 | A1* | 8/2016 | Park | H01F 17/0013 |
| 2016/0379750 | A1* | 12/2016 | Hamada | H01F 41/04 336/220 |

FOREIGN PATENT DOCUMENTS

| | | | |
|---|---|---|---|
| JP | 2003-133135 | A | 5/2003 |
| JP | 2003-142832 | A | 5/2003 |
| JP | 2010-062187 | A | 3/2010 |
| JP | 2010-147044 | A | 7/2010 |

OTHER PUBLICATIONS

An Office Action mailed by the Chinese Patent Office dated Jun. 21, 2019, which corresponds to Chinese Patent Application No. 201710536767.X and is related to U.S. Appl. No. 15/612,031 with English language translation.

An Office Action mailed by the Chinese Patent Office dated Sep. 29, 2018, which corresponds to Chinese Patent Application No. 201710536767.X and is related to U.S. Appl. No. 15/612,031 with English language translation.

An Office Action; "Notification of Reasons for Refusal," mailed by the Japanese Patent Office dated Mar. 12, 2019, 2019, which corresponds to Japanese Patent Application No. 2016-133797 and is related to U.S. Appl. No. 15/612,031; with English language translation.

* cited by examiner

2ND MODEL ; $X3=12\times10^{-6}/℃$

3RD MODEL ; $X3=18\times10^{-6}/℃$

4TH MODEL ; $X3=24\times10^{-6}/℃$

5TH MODEL ; $X3=30\times10^{-6}/℃$

6TH MODEL ; $X3=36\times10^{-6}/℃$

7TH MODEL : $X5=12\times10^{-6}/℃$

8H MODEL : $X5=18\times10^{-6}/℃$

9TH MODEL $X5=24\times10^{-6}/℃$

10TH MODEL $X5=30\times10^{-6}/℃$

13TH MODEL : $X5=12\times10^{-6}/℃$

14TH MODEL : $X5=18\times10^{-6}/℃$

15TH MODEL : $X5=24\times10^{-6}/℃$

16TH MODEL : $X5=30\times10^{-6}/℃$

17TH MODEL : $X5=36\times10^{-6}/℃$

ELECTRONIC COMPONENT

CROSS REFERENCE TO RELATED APPLICATIONS

This application claims benefit of priority to Japanese Patent Application 2016-133797 filed Jul. 6, 2016, the entire content of which is incorporated herein by reference.

TECHNICAL FIELD

The present disclosure relates to an electronic component including an inductor.

BACKGROUND

Examples of an existing disclosure relating to an electronic component include a coil component described in Japanese Unexamined Patent Application Publication No. 2003-133135. FIG. 15 is a sectional view of the structure of a coil component 500 described in Japanese Unexamined Patent Application Publication No. 2003-133135.

As illustrated in FIG. 15, the coil component 500 includes magnetic substrates 501 and 502, a laminated body 510, coils 512 and 513, a magnetic layer 520, and a bonding layer 530. The laminated body 510 is disposed on the upper surface of the magnetic substrate 501. The laminated body 510 is formed by laminating a plurality of insulating layers one on top of another. The coils 512 and 513 each include coil patterns, laminated together with the insulating layers, and a via hole. The coils 512 and 513 are installed in the laminated body 510. Recesses 514 and 515, which vertically extend through the laminated body 510, are formed in the laminated body 510. The magnetic layer 520 is disposed in the recesses 514 and 515 and over the upper surface of the laminated body 510. The bonding layer 530 bonds the upper surface of the magnetic layer 520 and the magnetic substrate 502 together.

SUMMARY

The coils 512 and 513 in the coil component 500 may be broken in some cases. More specifically, when the coil component 500 is mounted on a circuit board, the coil component 500 is subjected to heat treatment such as reflow soldering. When the coil component 500 is heated, each component in the coil component 500 expands thermally. Here, the coefficient of linear expansion of the coils 512 and 513 is smaller than the coefficient of linear expansion of the laminated body 510 and the coefficient of linear expansion of the magnetic layer 520. In addition, the material of the laminated body 510 and the material of the magnetic layer 520 are a polyimide resin. The coefficient of linear expansion of the laminated body 510 and the coefficient of linear expansion of the magnetic layer 520 thus have a small difference therebetween. Thus, when the coil component 500 is heated, the laminated body 510 and the magnetic layer 520 expand a larger amount per unit volume (the amount is hereinafter simply referred to as an amount of expansion) than an amount of expansion of the coils 512 and 513. Thus, the deformation of the coils 512 and 513 fails to follow the deformation of the laminated body 510 and the magnetic layer 520. This failure to follow the deformation causes tensile stress on the coils 512 and 513, whereby the coils 512 and 513 may be broken at a portion in the coil pattern, at a junction between the coil pattern and the via hole, or at other portions.

Accordingly, the present disclosure aims to provide an electronic component capable of preventing an inductor from causing wire breakage.

An electronic component according to a first aspect of the disclosure includes a body, a first inductor, and a low expansion portion. The body includes a laminated body including a plurality of insulating layers laminated in a lamination direction, the insulating layers containing a first resin as a material. The first inductor includes a first inductor conductor layer that adjoins one of the insulating layers. The low expansion portion has a coefficient of linear expansion lower than a coefficient of linear expansion of the plurality of insulating layers. The low expansion portion contains a second resin as a material and at least part of the low expansion portion is embedded in the laminated body. The second resin has a coefficient of linear expansion that is lower than a coefficient of linear expansion of the first resin.

An electronic component according to a second aspect of the disclosure includes a body, a first inductor, and a low expansion portion. The body includes a laminated body including a plurality of insulating layers laminated in a lamination direction, the insulating layers containing a first resin as a material. The first inductor includes a first inductor conductor layer that adjoins one of the insulating layers. The low expansion portion has a coefficient of linear expansion lower than a coefficient of linear expansion of the plurality of insulating layers. The low expansion portion contains a second resin as a material and at least part of the low expansion portion is embedded in the laminated body. The low expansion portion is non-magnetic.

An electronic component according to a third aspect of the disclosure includes a body and a first inductor. The body includes a laminated body and a first substrate. The laminated body includes a plurality of insulating layers laminated in a lamination direction. The insulating layers contain a resin as a material. The first substrate has a coefficient of linear expansion lower than a coefficient of linear expansion of the plurality of insulating layers. The first substrate adjoins a first main surface of the laminated body. The first main surface is located on a first side in the lamination direction. The first inductor includes a first inductor conductor layer that adjoins one of the insulating layers. The laminated body has a gap portion that adjoins the first substrate.

According to aspects of the present disclosure, inductors are prevented from causing wire breakage.

Other features, elements, characteristics and advantages of the present disclosure will become more apparent from the following detailed description (with reference to the attached drawings).

DETAILED DESCRIPTION

Configuration of Electronic Component

Figure 1:
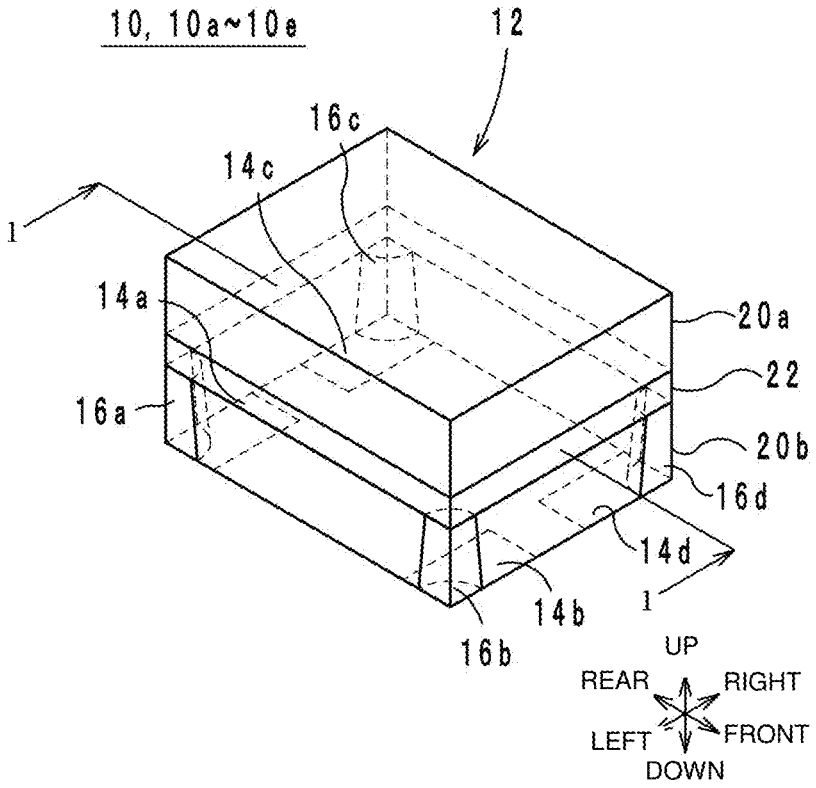
FIG. 1 is an external perspective view of an electronic component.
Figure 2:
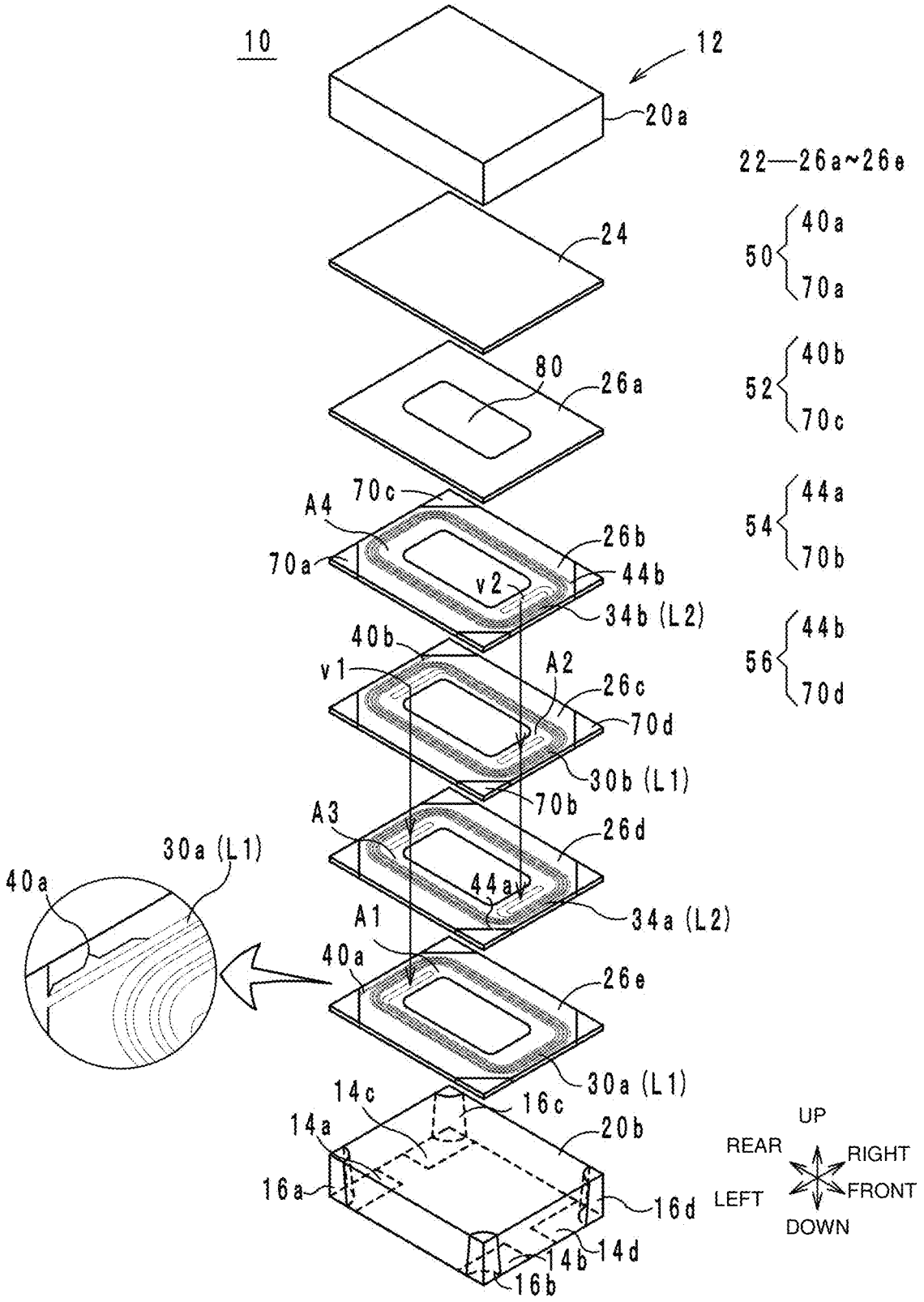
FIG. 2 is an exploded perspective view of the electronic component illustrated in FIG. 1.
Figure 3:
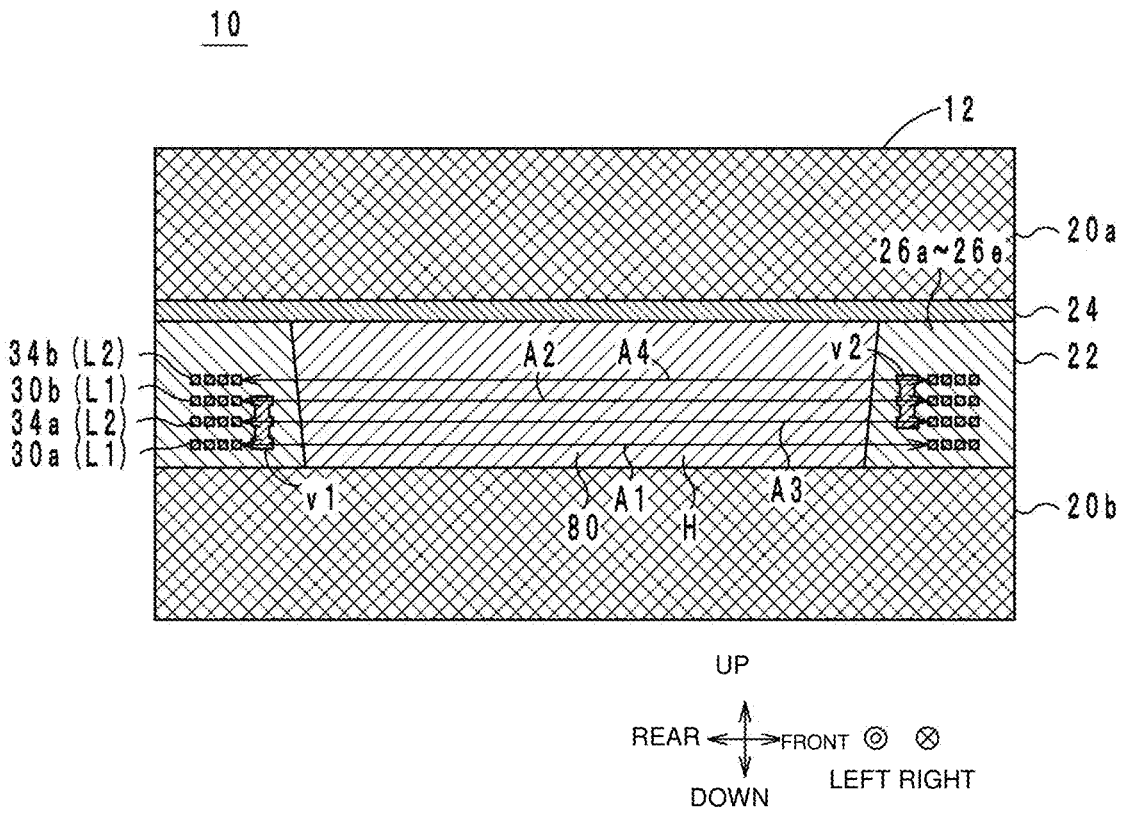
FIG. 3 is a sectional view of the structure of the electronic component illustrated in FIG. 1 taken along line 1-1.

Referring now to the drawings, a configuration of an electronic component 10 according to an embodiment is described first. FIG. 1 is an external perspective view of the electronic component 10. FIG. 2 is an exploded perspective view of the electronic component 10 illustrated in FIG. 1. FIG. 3 is a sectional view of the structure of the electronic component 10 illustrated in FIG. 1 taken along line 1-1. Hereinbelow, a lamination direction of the electronic component 10 is represented as a vertical direction. The direction in which long sides of the electronic component 10 extend when viewed from above is represented as a front-rear direction and the direction in which short sides of the electronic component 10 extend when viewed from above is represented as a lateral direction. The vertical direction, the front-rear direction, and the lateral direction are orthogonal to one another. Here, the lamination direction is a direction in which insulating layers, described below, are laminated one on top of another. The vertical direction, the lateral direction, and the front-rear direction of the electronic component 10 during use may respectively differ from the vertical direction, the lateral direction, and the front-rear direction represented in FIG. 1 or other drawings.

As illustrated in FIG. 1 to FIG. 3, the electronic component 10 includes a body 12, outer electrodes 14*a* to 14*d*, connection portions 16*a* to 16*d*, exit portions 50, 52, 54 and, 56, a low expansion portion 80, and inductors L1 and L2.

As illustrated in FIG. 1 and FIG. 2, the body 12 forms a rectangular prism shape and includes magnetic substrates 20*a* and 20*b*, a laminated body 22, and a bonding layer 24. The magnetic substrate 20*a*, the bonding layer 24, the laminated body 22, and the magnetic substrate 20*b* are laminated in this order from top to bottom.

The magnetic substrates 20*a* and 20*b* are plate-shaped members each having main surfaces having a rectangular shape when viewed from above. Hereinbelow, the upper main surface of each of the magnetic substrates 20*a* and 20*b* is referred to as a top surface and the lower main surface of each of the magnetic substrates 20*a* and 20*b* is referred to as an undersurface. The surfaces of each of the magnetic substrates 20*a* and 20*b* that connect the top surface and the undersurface are referred to as side surfaces. When viewed from above, the magnetic substrate 20*b* has four corners that are cut out. More specifically, the magnetic substrate 20*b* has, at four corners, cuts each having a sector shape having a central angle of 90 degrees when viewed from above. The four cuts vertically extend in the side surfaces of the magnetic substrate 20*b* from the top surface to the undersurface of the magnetic substrate 20*b*.

The magnetic substrates 20*a* and 20*b* are produced by milling a sintered ferrite ceramic. Alternatively, the magnetic substrates 20*a* and 20*b* may be produced by applying, for example, a paste consisting of a ferrite calcination powder and a binder to a ceramic substrate such as alumina or may be produced by laminating and firing green sheets of a ferrite material. The magnetic substrates 20*a* and 20*b* have a coefficient X1 of linear expansion. For example, the coefficient X1 of linear expansion falls within the range of approximately $7\times10^{-6}$/° C. to $11\times10^{-6}$/° C. and is approximately $9.5\times10^{-6}$/° C. in this embodiment.

The outer electrodes 14*a* to 14*d* are disposed on the undersurface of the magnetic substrate 20*b* and each have a rectangular shape. More specifically, the outer electrode 14*a* is disposed at a rear left corner of the undersurface of the magnetic substrate 20*b*. The outer electrode 14*b* is disposed at a front left corner of the undersurface of the magnetic substrate 20*b*. The outer electrode 14*c* is disposed at a rear right corner of the undersurface of the magnetic substrate 20*b*. The outer electrode 14*d* is disposed at a front right corner of the undersurface of the magnetic substrate 20*b*. The outer electrodes 14*a* to 14*d* are produced by depositing a material such as Ag, Ni, Cu, or Ti in a superposing manner by sputtering. Alternatively, the outer electrodes 14*a* to 14*d* may be produced by printing and baking a paste containing a metal or by depositing a metal by vapor deposition or plating.

The connection portions 16*a* to 16*d* are respectively disposed in the four cuts in the magnetic substrate 20*b*. The connection portion 16*a* is disposed in the rear left cut of the magnetic substrate 20*b* and connected to the outer electrode 14*a* at its lower end. The connection portion 16*b* is disposed in the front left cut of the magnetic substrate 20*b* and connected to the outer electrode 14*b* at its lower end. The connection portion 16*c* is disposed in the rear right cut of the magnetic substrate 20*b* and connected to the outer electrode 14*c* at its lower end. The connection portion 16*d* is disposed in the front right cut of the magnetic substrate 20*b* and connected to the outer electrode 14*d* at its lower end. The connection portions 16*a* to 16*d* are produced by depositing a material such as Ag, Ni, Cu, or Ti in a superposing manner by sputtering. Alternatively, the connection portions 16*a* to 16*d* may be produced by printing and baking a paste containing a metal or by depositing a metal by vapor deposition or plating.

The laminated body 22 includes insulating layers 26*a* to 26*e* (examples of multiple insulating layers) laminated on the top surface of the magnetic substrate 20*b*. The laminated body 22 has main surfaces having a rectangular shape when viewed from above. Hereinbelow, the upper main surface of the laminated body 22 is referred to as a top surface (an example of a second main surface located on one side of the laminated body in the lamination direction) and the lower main surface of the laminated body 22 is referred to as an undersurface (an example of a first main surface located on one side of the laminated body in the lamination direction). The laminated body 22 is directly disposed on the top surface of the magnetic substrate 20*b*. Thus, the magnetic substrate 20*b* (an example of a first substrate) adjoins the undersurface of the laminated body 22.

The insulating layers 26*a* to 26*e* are laminated in this order from top to bottom. The insulating layers 26*a* to 26*e* each have substantially the same shape as the top surface of the magnetic substrate 20*b*. When viewed from above, however, the insulating layers 26*b* to 26*e* have cuts at four corners.

The insulating layers 26*a* to 26*e* contain an insulating resin (an example of a first resin) as their material. In this embodiment, the insulating layers 26*a* to 26*e* are made of polyimide. The insulating layers 26*a* to 26*e* are thus non-magnetic. The insulating layers 26*a* to 26*e* may be made of, for example, an insulating resin such as benzocyclobutene or an epoxy resin. In the following description, the upper main surface of each of the insulating layers 26*a* to 26*e* is referred to as a top surface and the lower main surface of each of the insulating layers 26*a* to 26*e* is referred to as an undersurface. The insulating layers 26*a* to 26*e* have a coefficient X2 of linear expansion. The coefficient X2 of linear expansion is higher than the coefficient X1 of linear expansion. In other words, the coefficient X1 of linear expansion is lower than the coefficient X2 of linear expansion. Typically, the coefficient of linear expansion of a photosensitive resin is higher than the coefficient of linear expansion of a magnetic substrate. In this embodiment, the coefficient X2 of linear expansion is, for example, approximately $36\times10^{-6}/°$ C. The insulating resin, which is a material of the insulating layers 26*a* to 26*e*, has a coefficient x2 of linear expansion. In this embodiment, the insulating layers 26*a* to 26*e* are made purely of the insulating resin. Thus, the coefficient x2 of linear expansion is equal to the coefficient X2 of linear expansion.

The bonding layer 24 flattens the top surface of the laminated body 22 and bonds the magnetic substrate 20*a* (an example of a second substrate) and the top surface of the laminated body 22 together. The bonding layer 24 is made of, for example, an organic bonding material (such as polyimide). The bonding layer 24 has a coefficient X3 of linear expansion. The coefficient X3 of linear expansion is, for example, higher than or equal to approximately $12\times10^{-6}/°$ C. and lower than or equal to approximately $36\times10^{-6}/°$ C. In this embodiment, the coefficient X3 of linear expansion is, for example, approximately $18\times10^{-6}/°$ C.

The inductor L1 is disposed in the laminated body 22 and includes inductor conductor layers 30*a* and 30*b* and an interlayer connection conductor v1. The inductor conductor layer 30*a* (an example of a first inductor conductor layer) is disposed on the top surface of the insulating layer 26*e* (an example of a first insulating layer). When viewed from above, the inductor conductor layer 30*a* forms a substantially spiral shape that winds clockwise (an example of a predetermined direction) from the external side toward the internal side. Thus, the inductor conductor layer 30*a* adjoins the insulating layers 26*d* and 26*e*. When viewed from above, the center of the inductor conductor layer 30*a* is substantially aligned with the center of the electronic component 10 (point of intersection of diagonal lines).

The inductor conductor layer 30*b* is disposed on the top surface of the insulating layer 26*c*. When viewed from above, the inductor conductor layer 30*b* forms a substantially spiral shape that winds clockwise (an example of a predetermined direction) from the internal side toward the external side. Thus, the inductor conductor layer 30*b* adjoins the insulating layers 26*b* and 26*c*. When viewed from above, the center of the inductor conductor layer 30*b* is substantially aligned with the center of the electronic component 10 (point of intersection of diagonal lines).

The interlayer connection conductor v1 is a conductor that vertically extends through the insulating layers 26*c* and 26*d* and that is disposed on the top surface of the insulating layer 26*e*. When viewed from above, the interlayer connection conductor v1 forms a laterally extending line. When viewed from above, the interlayer connection conductor v1 is disposed in rear half areas of the insulating layers 26*c* to 26*e*. The interlayer connection conductor v1 connects an internal end portion of the inductor conductor layer 30*a* and an internal end portion of the inductor conductor layer 30*b* together. Thus, the inductor conductor layer 30*a* and the inductor conductor layer 30*b* are electrically connected together in series. The direction in which the inductor conductor layer 30*a* winds is the same as the direction in which the inductor conductor layer 30*b* winds. This configuration forms the inductor L1 having turns, the number of which is the sum of the number of turns of the inductor conductor layer 30*a* and the number of turns of the inductor conductor layer 30*b*.

The exit portion 50 connects an external end portion of the inductor conductor layer 30*a* and the outer electrode 14*a* together. The exit portion 50 includes an exit conductor layer 40*a* and a connection conductor 70*a*. The connection conductor 70*a* is a conductor having a triangular prism shape and disposed at the rear left corners of the insulating layers 26*b* to 26*e*. Here, the connection conductor 70*a* does not have to have a perfect triangular prism shape. Specifically, the connection conductor 70*a* may have one or more protrusions or one or more depressions on its side surfaces. In FIG. 2, the connection conductor 70*a* is illustrated in such a manner as to be divided into four sections for ease of understanding. Similarly to the connection conductor 70*a*, each of connection conductors 70*b* to 70*d* is illustrated in such a manner as to be divided into four sections. The connection conductor 70*a* vertically extends from the top surface of the insulating layers 26*b* to the undersurface of the insulating layer 26*e* and is connected to the connection portions 16*a* at its lower end.

The exit conductor layer 40*a* is disposed on the top surface of the insulating layer 26*e* and connects the external end portion of the inductor conductor layer 30*a* and the connection conductor 70*a* together. When viewed from above, the exit conductor layer 40*a* does not form a substantially spiral shape and extends leftward from the external end portion of the inductor conductor layer 30*a*. As illustrated in an enlarged view of FIG. 2, the boundary between the inductor conductor layer 30*a* and the exit conductor layer 40*a* is located at a position at which the exit conductor layer 40*a* deviates from the substantially spiral track formed by the inductor conductor layer 30*a*. Thus, the external end portion of the inductor conductor layer 30*a* and the outer electrode 14*a* are connected together with the exit portion 50 (exit conductor layer 40*a* and connection conductor 70*a*) and the connection portion 16*a* interposed therebetween.

The exit portion 52 connects the external end portion of the inductor conductor layer 30*b* and the outer electrode 14*c* together. The exit portion 52 includes an exit conductor layer 40*b* and a connection conductor 70*c*. The connection conductor 70*c* is a conductor having a triangular prism shape and disposed at the rear right corners of the insulating layers 26*b* to 26*e*. The connection conductor 70*c* vertically extends from the top surface of the insulating layer 26*b* to the undersurface of the insulating layer 26*e* and is connected to the connection portion 16*c* at its lower end.

The exit conductor layer 40*b* is disposed on the top surface of the insulating layer 26*c* and connects the external end portion of the inductor conductor layer 30*b* and the connection conductor 70*c* together. When viewed from above, the exit conductor layer 40*b* does not form a substantially spiral shape and extends rightward from the external end portion of the inductor conductor layer 30*b*. The boundary between the inductor conductor layer 30*b* and the exit conductor layer 40*b* is located at a position at which the exit conductor layer 40*b* deviates from the substantially spiral track formed by the inductor conductor layer 30*b*. Thus, the external end portion of the inductor conductor layer 30*b* and the outer electrode 14*c* are connected together with the exit portion 52 (exit conductor layer 40*b* and connection conductor 70*c*) and the connection portion 16*c* interposed therebetween.

When viewed from above, the area surrounded by the inductor L2 overlaps the area surrounded by the inductor L1. The inductor L2 is thus magnetically coupled with the inductor L1. The inductor L2 is disposed in the laminated body 22 and includes inductor conductor layers 34*a* and 34*b* and an interlayer connection conductor v2. The inductor conductor layer 34*a* (an example of a second inductor conductor layer) is disposed on the top surface of the insulating layers 26*d* (an example of a second insulating layer). When viewed from above, the inductor conductor layer 34*a* forms a substantially spiral shape that winds clockwise (an example of a predetermined direction) from the external side toward the internal side. Thus, the inductor conductor layer 34*a* adjoins the insulating layers 26*c* and 26*d*. When viewed from above, the center of the inductor conductor layer 34*a* is substantially aligned with the center of the electronic component 10 (point of intersection of diagonal lines).

The inductor conductor layer 34*b* is disposed on the top surface of the insulating layer 26*b*. When viewed from above, the inductor conductor layer 34*b* forms a substantially spiral shape that winds clockwise (an example of a predetermined direction) from the internal side toward the external side. Thus, the inductor conductor layer 34*b* adjoins the insulating layers 26*a* and 26*b*. When viewed from above, the center of the inductor conductor layer 34*b* is substantially aligned with the center of the electronic component 10 (point of intersection of diagonal lines).

The interlayer connection conductor v2 is a conductor that vertically extends through the insulating layers 26*b* and 26*c* and that is disposed on the top surface of the insulating layers 26*d*. When viewed from above, the interlayer connection conductor v2 forms a laterally extending line. When viewed from above, the interlayer connection conductor v2 is disposed in front half areas of the insulating layers 26*b* to 26*d*. The interlayer connection conductor v2 connects an internal end portion of the inductor conductor layer 34*a* and an internal end portion of the inductor conductor layer 34*b* together. Thus, the inductor conductor layer 34*a* and the inductor conductor layer 34*b* are electrically connected together in series. The direction in which the inductor conductor layer 34*a* winds is the same as the direction in which the inductor conductor layer 34*b* winds. This configuration forms the inductor L2 having turns, the number of which is the sum of the number of turns of the inductor conductor layer 34*a* and the number of turns of the inductor conductor layer 34*b*.

The exit portion 54 connects an external end portion of the inductor conductor layer 34*a* and the outer electrode 14*b* together. The exit portion 54 includes an exit conductor layer 44*a* and a connection conductor 70*b*. The connection conductor 70*b* is a conductor having a triangular prism shape and disposed at the front left corners of the insulating layers 26*b* to 26*e*. The connection conductor 70*b* vertically extends from the top surface of the insulating layers 26*b* to the undersurface of the insulating layer 26*e* and is connected to the connection portions 16*b* at its lower end.

The exit conductor layer 44*a* is disposed on the top surface of the insulating layer 26*d* and connects the external end portion of the inductor conductor layer 34*a* and the connection conductor 70*b* together. When viewed from above, the exit conductor layer 44*a* does not form a substantially spiral shape and extends frontward from the external end portion of the inductor conductor layer 34*a*. The boundary between the inductor conductor layer 34*a* and the exit conductor layer 44*a* is located at a position at which the exit conductor layer 44*a* deviates from the substantially spiral track formed by the inductor conductor layer 34*a*. Thus, the external end portion of the inductor conductor layer 34*a* and the outer electrode 14*b* are connected together with the exit portion 54 (exit conductor layer 44*a* and connection conductor 70*b*) and the connection portion 16*b* interposed therebetween.

The exit portion 56 connects an external end portion of the inductor conductor layer 34*b* and the outer electrode 14*d* together. The exit portion 56 includes an exit conductor layer 44*b* and a connection conductor 70*d*. The connection conductor 70*d* is a conductor having a triangular prism shape and disposed at the front right corners of the insulating layers 26*b* to 26*e*. The connection conductor 70*d* vertically extends from the top surface of the insulating layers 26*b* to the undersurface of the insulating layer 26*e* and is connected to the connection portions 16*d* at its lower end.

The exit conductor layer 44*b* is disposed on the top surface of the insulating layer 26*b* and connects the external end portion of the inductor conductor layer 34*b* and the connection conductor 70*d* together. When viewed from above, the exit conductor layer 44*b* does not form a substantially spiral shape and extends frontward from the external end portion of the inductor conductor layer 34*b*. The boundary between the inductor conductor layer 34*b* and the exit conductor layer 44*b* is located at a position at which the exit conductor layer 44*b* deviates from the substantially spiral track formed by the inductor conductor layer 34*b*. Thus, the external end portion of the inductor conductor layer 34*b* and the outer electrode 14*d* are connected together with the exit portion 56 (exit conductor layer 44*b* and connection conductor 70*d*) and the connection portion 16*d* interposed therebetween.

The inductor conductor layers 30*a*, 30*b*, 34*a*, and 34*b*, the exit conductor layers 40*a*, 40*b*, 44*a*, and 44*b*, the connection conductors 70*a* to 70*d*, and the interlayer connection conductors v1 and v2 are produced by depositing a material such as Ag, Ni, Cu, or Ti in a superposing manner by sputtering. Alternatively, the inductor conductor layers 30*a*, 30*b*, 34*a*, and 34*b*, the exit conductor layers 40*a*, 40*b*, 44*a*, and 44*b*, the connection conductors 70*a* to 70*d*, and the interlayer connection conductors v1 and v2 may be produced by printing and baking a paste containing a metal or by depositing a metal by vapor deposition or plating. The inductor conductor layers 30*a*, 30*b*, 34*a*, and 34*b*, the exit conductor layers 40*a*, 40*b*, 44*a*, and 44*b*, the connection conductors 70*a* to 70*d*, and the interlayer connection conductors v1 and v2 have a coefficient X4 of linear expansion. The coefficient X4 of linear expansion is lower than the coefficient X2 of linear expansion. The coefficient of linear expansion of Ag is approximately $18.9\times10^{-6}$/° C., the coefficient of linear expansion of Cu is approximately $16.5\times10^{-6}$/° C., and the coefficient of linear expansion of Au is approximately $14.2\times10^{-6}$/° C.

The low expansion portion 80 forms a rectangular prism shape that extends vertically and at least part of the low expansion portion 80 is embedded in the laminated body 22. In FIG. 2, the low expansion portion 80 is illustrated in such a manner as to be divided into five sections for ease of understanding. In this embodiment, as illustrated in FIG. 3, the laminated body 22 has a through hole H, which vertically extends through the laminated body 22. When viewed from above, the through hole H is located in the areas surrounded by the inductors L1 and L2. More specifically, the through hole H vertically extends through areas A1 to A4 respectively surrounded by the inductor conductor layers 30*a*, 30*b*, 34*a*, and 34*b*. The low expansion portion 80 is disposed in the through hole H. Thus, the low expansion portion 80 is located in the areas A1 to A4. The top surface and the undersurface of the low expansion portion 80 are exposed through the top surface and the undersurface of the laminated body 22. The low expansion portion 80, however, adjoins the magnetic substrate 20*b* at the lower end of the through hole H (an end portion on one side of the laminated body in the lamination direction) and adjoins the bonding layer 24 at the upper end of the through hole H (an end portion on the other side of the laminated body in the lamination direction). Thus, the low expansion portion 80 is not exposed through the body 12.

As described above, the state where at least part of the low expansion portion 80 is embedded in the laminated body 22 represents that at least part of the low expansion portion 80 is disposed in the laminated body 22. In other words, the configuration in which at least part of the low expansion portion 80 is embedded in the laminated body 22 does not include the configuration in which a resin is applied to the surface of the laminated body 22. Specifically, the low expansion portion 80 is different from the bonding layer 24. In this embodiment, the entirety of the low expansion portion 80 is located in the laminated body 22 and the top surface and the undersurface of the low expansion portion 80 are exposed through the laminated body 22. Alternatively, the low expansion portion 80 may protrude beyond the top surface of the laminated body 22. Instead, the low expansion portion 80 does not have to be exposed through the laminated body 22.

When viewed from above, the low expansion portion 80 forms a rectangular shape having long sides extending in the front-rear direction and short sides extending in the lateral direction. When viewed from above, the interlayer connection conductor v1 extends along the rear short side of the low expansion portion 80. When viewed from above, the interlayer connection conductor v2 extends along the front short side of the low expansion portion 80.

The low expansion portion 80 contains an insulating resin (an example of a second resin) as a material. In this embodiment, the insulating resin is formed by mixing a silica filler into a non-photosensitive polyimide resin. The content of the silica filler is approximately 57% by volume of the low expansion portion 80. Thus, the low expansion portion 80 is non-magnetic. The low expansion portion 80 has a coefficient X5 of linear expansion. The coefficient X5 of linear expansion is lower than the coefficient X2 of linear expansion. The coefficient X5 of linear expansion is, for example, higher than or equal to approximately $12\times10^{-6}$/° C. and lower than or equal to approximately $30\times10^{-6}$/° C. In this embodiment, the coefficient X5 of linear expansion is, for example, approximately $12\times10^{-6}$/° C. The insulating resin, which is a material of the low expansion portion 80, has a coefficient x5 of linear expansion. The coefficient x5 of linear expansion is lower than the coefficient x2 of linear expansion. The insulating resin is a non-photosensitive polyimide resin and thus the coefficient x5 of linear expansion is approximately $18\times10^{-6}$/° C. The coefficient X5 of linear expansion of the low expansion portion 80 is thus rendered lower than the coefficient x5 of linear expansion of the insulating resin due to mixing of the silica filler into the non-photosensitive polyimide resin.

The operation of the electronic component 10 having the above-described configuration is described below. The outer electrodes 14*a* and 14*b* are used as input terminals. The outer electrodes 14*c* and 14*d* are used as output terminals.

Differential transmission signals are input to the outer electrodes 14*a* and 14*b* and output from the outer electrodes 14*c* and 14*d*. When a normal mode signal in the differential transmission signals flows through the inductors L1 and L2, the inductors L1 and L2 produce magnetic fluxes in opposite directions in response to the normal mode signal. The magnetic fluxes thus cancel each other, so that impedance is less likely to be presented to the current of the normal mode signal. When, on the other hand, the differential transmission signals include a common mode noise, the inductors L1 and L2 produce magnetic fluxes in the same direction in response to the current of the common mode noise. Thus, the magnetic fluxes enhance each other so that impedance is presented to the current of the common mode noise. As a result, the current of the common mode noise is converted into heat and hindered from passing through the inductors L1 and L2. In this manner, the inductor L1 and the inductor L2 form a common mode choke coil as a result of being magnetically coupled with each other.

Method for Manufacturing Electronic Component

A method for manufacturing the electronic component 10 is described below. A case where one electronic component 10 is manufactured is described below as an example. Actually, however, multiple electronic components 10 are concurrently formed as a result of laminating large mother magnetic substrates and mother insulating layers together to form a mother body and cutting the mother body into pieces.

Firstly, a polyimide resin, which is a photosensitive resin, is applied to the entirety of the top surface of the magnetic substrate 20*b*. Subsequently, the polyimide resin is exposed to light while portions corresponding to the four corners of the insulating layer 26*e* are shielded from light. Thus, the polyimide resin at the portion that has not been shielded from light is cured. Thereafter, an uncured polyimide resin is removed by an organic solvent in a developing process and the polyimide resin is subjected to thermosetting. Thus, the insulating layer 26*e* is formed.

Subsequently, a Cu film is deposited by sputtering on the insulating layer 26*e* and the magnetic substrate 20*b* exposed through the insulating layer 26*e*. Then, a photoresist is disposed at portions at which the inductor conductor layer 30*a*, the exit conductor layer 40*a*, the connection conductors 70*a* to 70*d*, and the interlayer connection conductor v1 are to be formed. Then, a Ag film is removed by etching at the portion other than the portions (that is, the portions covered with the photoresist) at which the inductor conductor layer 30*a*, the exit conductor layer 40*a*, the connection conductors 70*a* to 70*d*, and the interlayer connection conductor v1 are to be formed. The photoresist is then removed by the organic solvent, so that the inductor conductor layer 30*a*, the exit conductor layer 40*a*, part of the connection conductors 70*a* to 70*d* (corresponding to one layer), and part of the interlayer connection conductor v1 are formed.

The step similar to the above-described step is repeated to form the insulating layers 26*a* to 26*d*, the inductor conductor layers 30*b*, 34*a*, and 34*b*, the exit conductor layers 40*a*, 44*a*, and 44*b*, the remaining portions of the connection conductors 70*a* to 70*d*, the remaining portion of the interlayer connection conductor v1, and the interlayer connection conductor v2.

Subsequently, a resist that covers a portion of the insulating layers 26*a* other than the portion at which the low expansion portion 80 is to be formed is disposed on the top surface of the insulating layers 26*a*. Then, a through hole H that vertically extends through the insulating layers 26*a* to 26*e* is formed by sandblasting using the resist as a mask. The resist is then removed by an organic solvent. Here, the through hole H may be formed by laser processing, by a combination of sandblasting and laser processing, or by etching.

The through hole H is then filled, by screen printing, with a resin into which a silica filler is mixed. The resin into which a silica filler is mixed is to form the low expansion portion 80. The resin is, for example, a non-photosensitive polyimide resin and has a low coefficient of linear expansion.

Then, a resin that is to form the bonding layer 24 is applied to the surface of the laminated body 22 and the magnetic substrate 20*a* is then fixed onto the bonding layer 24 by heat treatment and pressing treatment.

Subsequently, four cuts are formed in the magnetic substrate 20*b* by sandblasting. Instead of sandblasting, the cuts may be formed by laser processing or by a combination of sandblasting and laser processing.

Finally, conductor layers are formed on the inner surfaces of the cuts of the magnetic substrate 20*b* by a combination of electroplating and photolithography to form the connection portions 16*a* to 16*d* and the outer electrodes 14*a* to 14*d*.

Effects

Firstly, the relationship between the coefficients X1 to X5, x2, and x5 of linear expansion of the portions of the electronic component 10 is clarified.

(1) The coefficient X4 of linear expansion of the inductor conductor layers 30*a*, 30*b*, 34*a*, and 34*b*, the exit conductor layers 40*a*, 40*b*, 44*a*, and 44*b*, and the connection conductors 70*a* to 70*d* is lower than the coefficient X2 of linear expansion of the insulating layers 26*a* to 26*e*.

(2) The coefficient X5 of linear expansion of the low expansion portion 80 is lower than the coefficient X2 of linear expansion of the insulating layers 26*a* to 26*e*.

(3) The coefficient x5 of linear expansion of the insulating resin from which the low expansion portion 80 is made is lower than the coefficient x2 of linear expansion of the insulating resin from which the insulating layers 26*a* to 26*e* are made.

(4) The coefficient X1 of linear expansion of the magnetic substrates 20*a* and 20*b* is lower than the coefficient X2 of linear expansion of the insulating layers 26*a* to 26*e*.

(5) The coefficient X5 of linear expansion of the low expansion portion 80 is lower than the coefficient X3 of linear expansion of the bonding layer 24.

The electronic component 10 according to this embodiment is capable of preventing the inductors L1 and L2 from causing wire breakage. More specifically, the coefficient X4 of linear expansion of the inductors L1 and L2 (inductor conductor layers 30*a*, 30*b*, 34*a*, and 34 and interlayer connection conductors v1 and v2) is lower than the coefficient X2 of linear expansion of the insulating layers 26*a* to 26*e*. Thus, when the electronic component 10 is heated, the insulating layers 26*a* to 26*e* expand to a larger extent than the extent to which the inductors L1 and L2 expand. Thus, tensile stress is exerted on the inductors L1 and L2. Such tensile stress causes wire breakage or partial wire breakage of the inductors L1 and L2, which results in a conductivity reduction.

Thus, the electronic component 10 includes the low expansion portion 80, at least part of which is embedded in the laminated body 22. The coefficient x5 of linear expansion of the insulating resin from which the low expansion portion 80 is made is lower than the coefficient x2 of linear expansion of the insulating resin of the insulating layers 26*a* to 26*e*. Moreover, the low expansion portion 80 is made of a material in which a silica filler is mixed in the insulating resin. Thus, the coefficient X5 of linear expansion of the low expansion portion 80 is lower than the coefficient x5 of linear expansion of the insulating resin. The coefficient X5 of linear expansion of the low expansion portion 80 is thus significantly lower than the coefficient X2 of linear expansion of the insulating layers 26*a* to 26*e*. Thus, when the electronic component 10 is heated, the low expansion portion 80 expands to a smaller extent than the extent to which the insulating layers 26*a* to 26*e* expand. The stress caused by the expansion of the insulating layers 26*a* to 26*e* is thus likely to be discharged toward the low expansion portion 80. In this manner, the tensile stress exerted on the inductors L1 and L2 decreases, so that an occurrence of wire breakage in the inductors L1 and L2 is prevented.

The insulating layers 26*a* to 26*e* in the electronic component 10 are formed by photolithography. Thus, the insulating layers 26*a* to 26*e* are made of a resin suitable for photolithography. Such a resin is limited to resins having a relatively large coefficient of linear expansion. On the other hand, the low expansion portion 80 is formed by filling the through hole H with a resin. Thus, the resin usable for the low expansion portion 80 is selectable from a wider choice of options than the choice of options from which the resin usable for the insulating layers 26*a* to 26*e* is selected. Thus, a resin having the coefficient x5 of linear expansion, which is relatively small, is usable for the low expansion portion 80.

The electronic component 10 is capable of effectively preventing an occurrence of wire breakage in the inductors L1 and L2 also due to the following reasons. More specifically, in the electronic component 10, the presence of the low expansion portion 80 is capable of effectively preventing portions of the insulating layers 26*a* to 26*e* located adjacent to the low expansion portion 80 from expanding further than portions of the insulating layers 26*a* to 26*e* located further away from the low expansion portion 80. Thus, in view of preventing an occurrence of wire breakage of the inductors L1 and L2, it is preferable that the inductors L1 and L2 be located adjacent to the low expansion portion 80.

Thus, the inductor conductor layers 30*a*, 30*b*, 34*a*, and 34*b* each form a substantially spiral shape that winds clockwise, when viewed from above. In addition, the low expansion portion 80 is located in the areas surrounded by the inductors L1 and L2, when viewed from above. Specifically, a large part of the inductor conductor layers 30*a*, 30*b*, 34*a*, and 34*b* is located adjacent to the low expansion portion 80. This configuration thus more effectively prevents an occurrence of wire breakage in the inductors L1 and L2.

The electronic component 10 effectively prevents an occurrence of wire breakage at connection portions between the interlayer connection conductor v1 and the inductor conductor layers 30*a* and 30*b* and at connection portions between the interlayer connection conductor v2 and the inductor conductor layers 34*a* and 34*b*. More specifically, wire breakage is more likely to occur at connection portions between the interlayer connection conductor v1 and the inductor conductor layers 30*a* and 30*b* and at connection portions between the interlayer connection conductor v2 and the inductor conductor layers 34*a* and 34*b*. Thus, the low expansion portion 80 in the electronic component 10 is located within the areas surrounded by the inductors L1 and L2, when viewed from above. The interlayer connection conductors v1 and v2 are located adjacent to the areas surrounded by the inductors L1 and L2, when viewed from above. Thus, the low expansion portion 80 is located adjacent to the interlayer connection conductors v1 and v2. This configuration thus reduces tensile stress exerted on the connection portions between the interlayer connection conductor v1 and the inductor conductor layers 30*a* and 30*b* and the connection portions between the interlayer connection conductor v2 and the inductor conductor layers 34*a* and 34*b*. Consequently, an occurrence of wire breakage at these connection portions is prevented.

Figure 4:
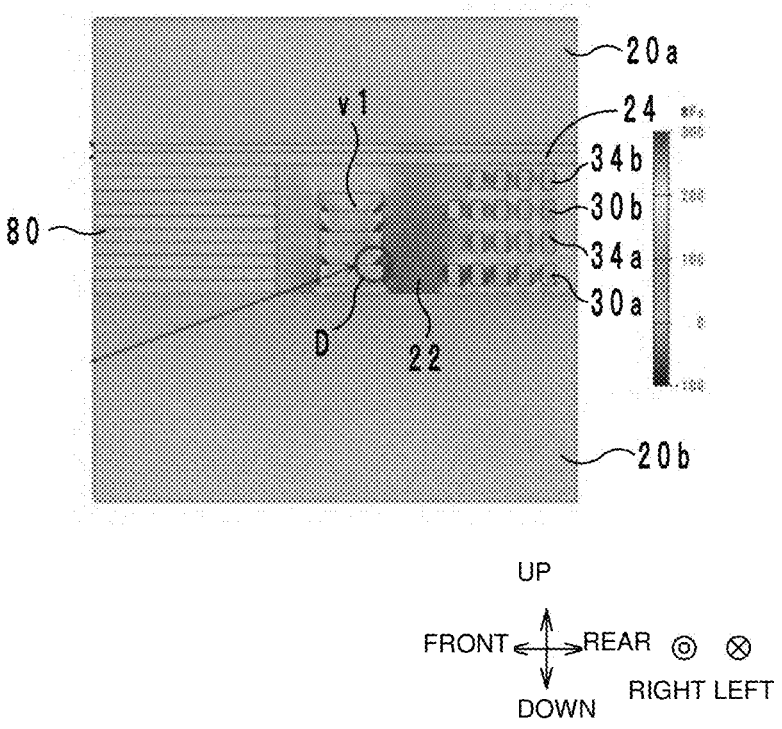
FIG. 4 illustrates a result of a first computer simulation.

The inventors of the application conducted a first computer simulation, described below, to clarify the effects of the electronic component 10. More specifically, the inventors of the application created a first model having the same structure as that of the electronic component 10. The temperature of the first model was raised from 25° C. to 270° C. and the tensile stress that occurred at each portion of the first model was calculated by a computer. FIG. 4 illustrates a result of a first computer simulation. In FIG. 4, stress that occurs at each portion of the first model is originally illustrated with colors. FIG. 4 substantially coincides with the sectional view of the structure in FIG. 3. FIG. 4, however, is a sectional view of the structure of the electronic component 10 viewed from the right, whereas FIG. 3 is a sectional view of the structure of the electronic component 10 viewed from the left. In addition, the number of turns of each of the inductors L1 and L2 differs between FIG. 3 and FIG. 4 since the position of the section slightly differs between FIG. 3 and FIG. 4.

The simulation conditions of the first computer simulation are described below.

The coefficient X1 of linear expansion is approximately $9.5\times10^{-6}$/° C.

The coefficient X2 of linear expansion is approximately $36\times10^{-6}$/° C.

The coefficient X3 of linear expansion is approximately $18\times10^{-6}$/° C.

The coefficient X4 of linear expansion is approximately $16.5\times10^{-6}$/° C.

The coefficient X5 of linear expansion is approximately $12\times10^{-6}$/° C.

FIG. 4 is originally formed as a color diagram but actually illustrated in black and white. In FIG. 4, a portion at which a stress of −100 MPa occurs is originally illustrated in dark blue. A portion at which a stress of 0 MPa occurs is originally illustrated in light blue. A portion at which a stress of 100 MPa occurs is originally illustrated in yellow green. A portion at which a stress of 200 MPa occurs is originally illustrated in yellow. A portion at which a stress of 300 MPa occurs is originally illustrated in red. FIG. 4 shows that a red portion form near the center of a portion enclosed with circle D and has the largest stress. The portion enclosed with circle D is a portion located in front of and near the lower end of the interlayer connection conductor v1. Specifically, the first computer simulation shows that wire breakage is particularly more likely to occur in the inductors L1 and L2 at a portion located in front of and near the lower end of the interlayer connection conductor v1.

Instead of the hard magnetic substrate 20*a*, the soft bonding layer 24 is disposed over the interlayer connection conductor v1. Thus, the stress in the insulating layer 26*a* is likely to be discharged to the bonding layer 24. Thus, a large tensile stress is less likely to occur near the upper end of the interlayer connection conductor v1.

In addition, the low expansion portion 80 is disposed in front of the interlayer connection conductor v2. This configuration prevents the insulating layers 26*b* to 26*d*, located in front of the interlayer connection conductor v2, from expanding to a large extent when the electronic component 10 is heated. Thus, a large tensile stress is less likely to occur at a portion in front of the interlayer connection conductor v2.

The volume of the portions of the insulating layers 26*a* to 26*e* located at the back of the interlayer connection conductor v1 is larger than the volume of the portions of the insulating layers 26*a* to 26*e* located in front of the interlayer connection conductor v1. Thus, the difference in amount of expansion between the insulating layers 26*a* to 26*e* and the portion located at the back of and near the lower end of the interlayer connection conductor v1 is larger than the difference in amount of expansion between the insulating layers 26*a* to 26*e* and the portion located in front of and near the upper end of the interlayer connection conductor v1. Thus, a large tensile stress is more likely to occur at the portion located at the back of and near the lower end of the interlayer connection conductor v2. Probably because of the above-described reason, wire breakage is particularly more likely to occur in the inductors L1 and L2 at a portion located at the back of and near the lower end of the interlayer connection conductor v2.

Figure 5:
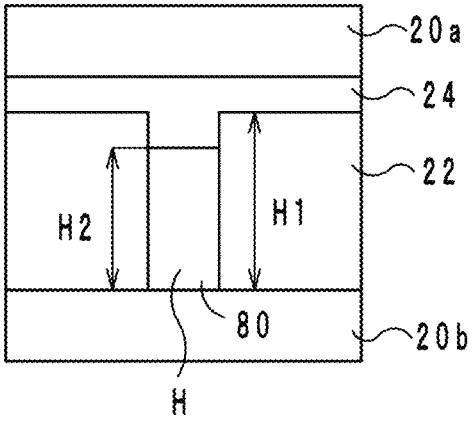
FIG. 5 illustrates a model of an electronic component used in a second computer simulation.
Figure 6:
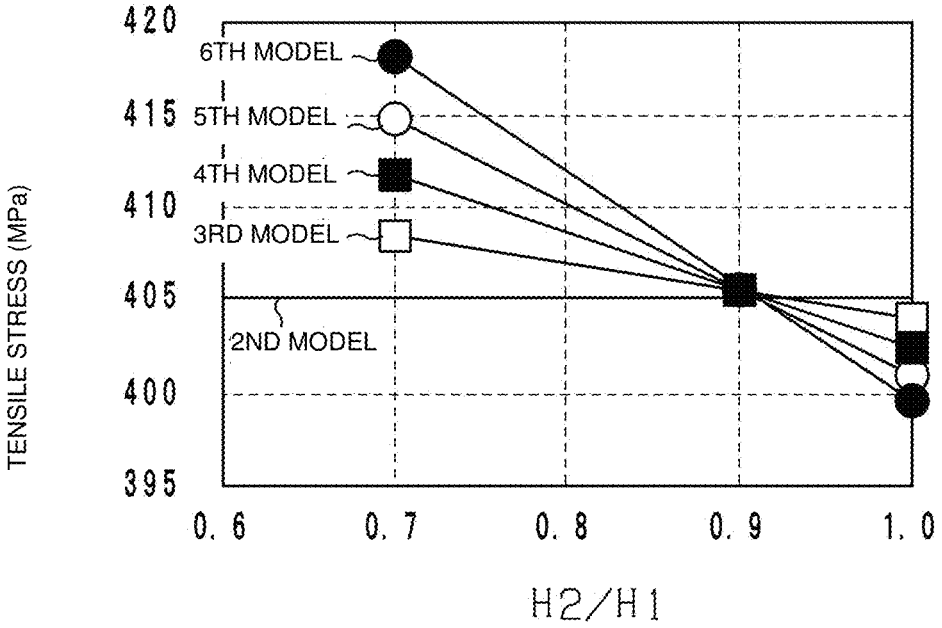
FIG. 6 is a graph showing the results of the second computer simulation.

Subsequently, the inventors of the application conducted a second computer simulation. FIG. 5 shows a model used in the second computer simulation. In the second computer simulation, the inventors of the application created the model illustrated in FIG. 5. In the model illustrated in FIG. 5, the bonding layer 24 enters the through hole H. In the model illustrated in FIG. 5, the height of the laminated body 22 is defined as a height H1 and the height of the low expansion portion 80 in the vertical direction is defined as a height H2. The inventors of the application created a second model to a sixth model, each having the structure of the model illustrated in FIG. 5. The coefficient X3 of linear expansion of the bonding layer 24 of the second model is approximately $12\times10^{-6}$/° C. The coefficient X3 of linear expansion of the bonding layer 24 of the third model is approximately $18\times10^{-6}$/° C. The coefficient X3 of linear expansion of the bonding layer 24 of the fourth model is approximately $24\times10^{-6}$/° C. The coefficient X3 of linear expansion of the bonding layer 24 of the fifth model is approximately $30\times10^{-6}$/° C. The coefficient X3 of linear expansion of the bonding layer 24 of the sixth model is approximately $36\times10^{-6}$/° C. The coefficients X1, X2, X4, and X5 of linear expansion are the same as those used in the first computer simulation. The inventors of the application caused the computer to calculate the tensile stress while H2/H1 in each of the second model to the sixth model was changed. The calculated tensile stress is the maximum tensile stress caused at the point enclosed by circle D in FIG. 4. FIG. 6 is a graph showing the results of the second computer simulation. The vertical axis indicates the tensile stress and the horizontal axis indicates H2/H1.

The graph of FIG. 6 shows that the tensile stress decreases with increasing H2/H1. In other words, wire breakage becomes less likely to occur in the inductors L1 and L2 as H2/H1 increases further. The graph thus shows that it is preferable that the through hole H be filled with the low expansion portion 80 without an entrance of the bonding layer 24. Specifically, the graph shows that it is preferable that the low expansion portion 80 be disposed in the through hole H so that it adjoins the magnetic substrate 20*b* at the lower end portion of the through hole H and adjoins the bonding layer 24 at the upper end portion of the through hole H.

When H2/H1 is approximately 0.7, the second to sixth models have lower tensile stress as their bonding layers 24 have smaller coefficients X3 of linear expansion. When H2/H1 is approximately 0.9, the second to sixth models have substantially equal tensile stress regardless of their coefficients X3 of linear expansion. When H2/H1 is approximately 1.0, the second to sixth models have higher tensile stress as their bonding layers 24 have larger coefficients X3 of linear expansion. Specifically, the relationship between the coefficient X3 of linear expansion and the tensile stress when H2/H1 is approximately 0.7 is opposite to the relationship between the coefficient X3 of linear expansion and the tensile stress when H2/H1 is approximately 1.0. Thus, the graph shows that it is preferable that the bonding layer 24 have a larger coefficient X3 of linear expansion when the bonding layer 24 does not enter the through hole H (specifically, when H2/H1 is approximately 1.0). FIG. 6 shows that it is preferable that the coefficient X3 of linear expansion of the bonding layer 24 be equal to the coefficient X2 of linear expansion (approximately $36\times10^{-6}$/° C.) of the insulating layers 26*a* to 26*e*.

Figure 7:
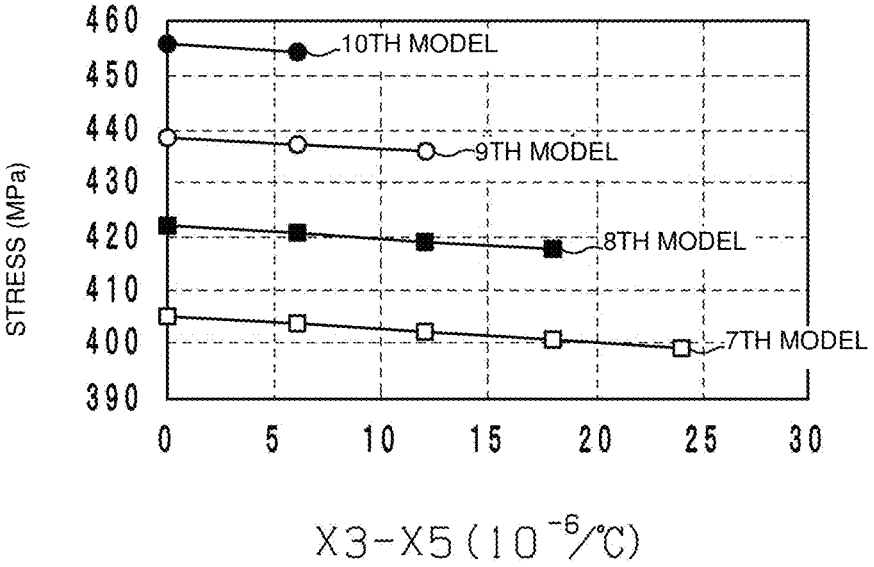
FIG. 7 is a graph showing the results of a third computer simulation.

The second computer simulation was conducted in the state where the coefficient X5 of linear expansion of the low expansion portion 80 was fixed at approximately $12\times10^{-6}$/° C. Then, the inventors of the application conducted the third computer simulation to confirm whether the results obtained from the third computer simulation in which the coefficient X5 of linear expansion is changed are the same as those obtained from the second computer simulation. In the third computer simulation, the inventors of the application created a model illustrated in FIG. 5. Here, H2/H1 was 1.0. The inventors of the application created seventh to tenth models, described below. The coefficient X5 of linear expansion of the low expansion portion of the seventh model is approximately $12\times10^{-6}$/° C. The coefficient X5 of linear expansion of the low expansion portion of the eighth model is approximately $18\times10^{-6}$/° C. The coefficient X5 of linear expansion of the low expansion portion of the ninth model is approximately $24\times10^{-6}$/° C. The coefficient X5 of linear expansion of the low expansion portion of the tenth model is approximately $30\times10^{-6}$/° C. The coefficients X1, X2, and X4 of linear expansion are the same as those used in the first computer simulation. The inventors of the application changed X3-X5 in the seventh to tenth models and caused the computer to calculate the tensile stress. The calculated tensile stress is the maximum tensile stress caused at the point enclosed by circle D in FIG. 4. FIG. 7 is a graph showing the results of the third computer simulation. The vertical axis indicates the tensile stress and the horizontal axis indicates X3-X5.

FIG. 7 shows that the tensile stress decreases as X3-X5 increases in either one of the seventh to tenth models. In other words, the tensile stress of any of the seventh to tenth models decreases as the coefficient X3 of linear expansion of the bonding layer 24 increases. Thus, the third computer simulation shows that a larger coefficient X3 of linear expansion is preferable when H2/H1 is approximately 1.0 regardless of the coefficient X5 of linear expansion.

First Modified Example

Figure 8:
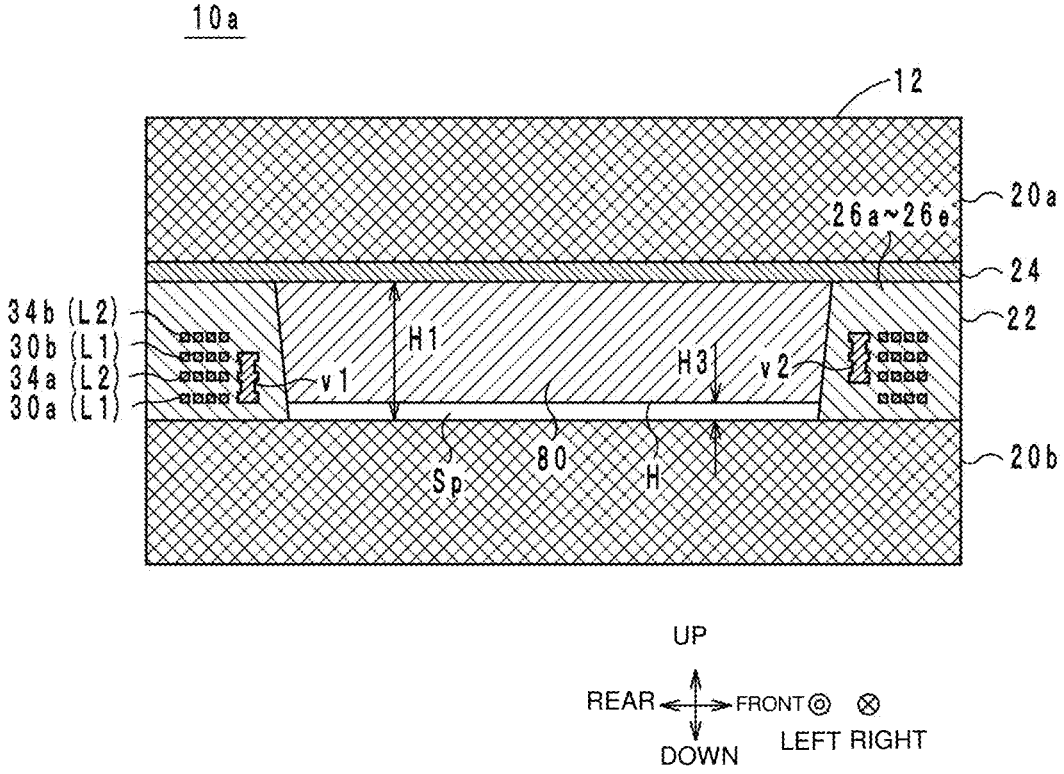
FIG. 8 is a sectional view of the structure of another electronic component.

Referring now to the drawings, an electronic component 10*a* according to a first modified example is described below. FIG. 8 is a sectional view of the structure of the electronic component 10*a*. The external perspective view of the electronic component 10*a* is the same as the external perspective view of the electronic component 10 illustrated in FIG. 1. FIG. 8 is a sectional view of the structure taken along line 1-1 in FIG. 1.

The electronic component 10*a* is different from the electronic component 10 in that it includes a gap portion Sp. The electronic component 10*a* is described below mainly focusing on this difference.

When viewed from above, the gap portion Sp is disposed at a portion in the laminated body 22 that overlaps the low expansion portion 80 and that adjoins the low expansion portion 80 and the magnetic substrate 20*b*. More specifically, a portion around the lower end portion of the through hole H is not filled with the low expansion portion 80. Thus, the gap portion Sp is formed near the lower end of the through hole H. The undersurface of the low expansion portion 80 faces the top surface of the magnetic substrate 20*b* with the gap portion Sp interposed therebetween.

Other portions of the electronic component 10*a* are the same as those of the electronic component 10 and thus are not described here.

Examples of a method for forming the gap portion Sp include an adjustment of resin viscosity or an adjustment of the speed of squeegeeing or the number of times of squeegeeing performed to fill the through hole H with resin by screen printing. More specifically, the low expansion portion 80 of the electronic component 10*a* may be made of a resin having higher viscosity than the viscosity of the resin from which the low expansion portion 80 of the electronic component 10 is made. An example of how to increase the resin viscosity is to increase an amount of a silica filler that is to be added to the resin. Alternatively, a gap portion Sp is more likely to be formed by increasing the speed of squeegeeing since the amount of resin with which the through hole H is filled decreases by increasing the speed of squeegeeing. Instead, a gap portion Sp is more likely to be formed by reducing the number of times of squeegeeing since the amount of resin with which the through hole H is filled decreases by reducing the number of times of squeegeeing.

The electronic component 10*a* having the above-described configuration includes the low expansion portion 80 having a coefficient of linear expansion that is smaller than the coefficient of linear expansion of the insulating layers 26*a* to 26*e*. This configuration is thus capable of preventing an occurrence of wire breakage in the inductors L1 and L2 for the same reason as in the case of the electronic component 10.

The electronic component 10*a* is also capable of preventing an occurrence of wire breakage in the inductors L1 and L2 for the reason described below. More specifically, the gap portion Sp contains purely air. The gap portion Sp thus hardly ever expands when the electronic component 10*a* is heated. On the other hand, the insulating layers around the gap portion Sp expand and compress the gap portion Sp. The gap portion Sp thus allows the insulating layers to be freely deformed, so that the tensile stress caused in the insulating layers around the gap portion Sp decreases. Consequently, the electronic component 10*a* reduces the tensile stress exerted on the inductors L1 and L2 and prevents an occurrence of wire breakage in the inductors L1 and L2.

The electronic component 10*a* is also capable of preventing an occurrence of wire breakage in the inductors L1 and L2 for the reason described below. The electronic component 10 is used for comparison to describe the effect of the electronic component 10*a*. More specifically, the second computer simulation and the third computer simulation have revealed that the tensile stress decreases when the coefficient X3 of linear expansion of the bonding layer 24 increases. This is because the tensile stress of portions of the insulating layers near the bonding layer 24 decreases due to the bonding layer 24 having a high coefficient X3 of linear expansion. In the electronic component 10, the bonding layer 24 is disposed between the magnetic substrate 20*a* and the top surface of the laminated body 22. The coefficient X3 of linear expansion of the bonding layer 24 is higher than the coefficient X5 of linear expansion of the low expansion portion 80. Thus, in the electronic component 10, the tensile stress near the upper end portion of the low expansion portion 80 is smaller than the tensile stress near the lower end portion of the low expansion portion 80.

The electronic component 10*a* thus has the gap portion Sp near the lower end of the through hole H, which is left hollow without being occupied by the low expansion portion 80. This gap portion Sp allows stress that occurs in portions of the insulating layers located around the lower end portion of the through hole H to be discharged thereto, so that the stress exerted to portions around the interlayer connection conductors v1 and v2 decreases. This configuration is thus capable of preventing an occurrence of wire breakage in the inductors L1 and L2.

Figure 9:
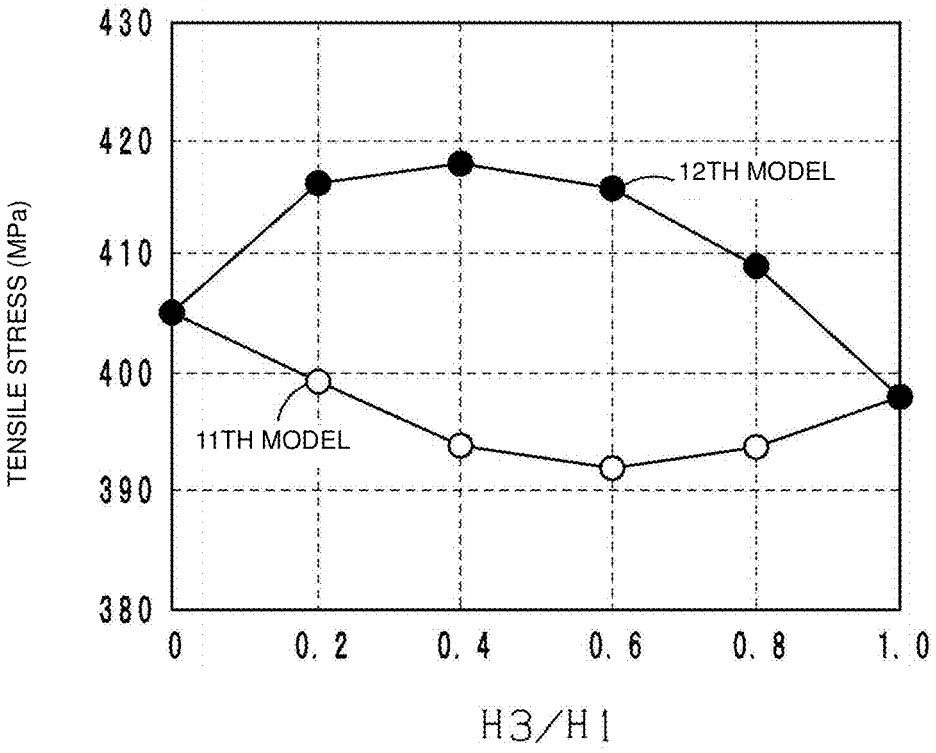
FIG. 9 is a graph showing the results of a fourth computer simulation.

The inventors of the application conducted a fourth computer simulation, described below, to further clarify the effects of the electronic component 10*a*. More specifically, the inventors of the application created eleventh and twelfth models. The eleventh model has a structure illustrated in FIG. 8. In the eleventh model, the gap portion gradually widens upward from the side near the magnetic substrate 20*b*. On the other hand, in the twelfth model, the gap portion is disposed near the magnetic substrate 20*a* (at an upper portion). In the twelfth model, the gap portion gradually widens downward from the side near the magnetic substrate 20*a*. The eleventh model is a model according to an embodiment, whereas the twelfth model is a model according to a comparative example. In the eleventh model and the twelfth model, the height of the laminated body 22 is defined as a height H1 and the height of the gap portion Sp in the vertical direction is defined as a height H3. The inventors of the application changed H3/H1 in the eleventh and twelfth models and caused a computer to calculate the stress. The calculated stress is the maximum stress caused at the point enclosed by circle D in FIG. 4. FIG. 9 is a graph showing the results of the fourth computer simulation. The vertical axis indicates the tensile stress and the horizontal axis indicates H3/H1. The simulation conditions of the fourth computer simulation are the same as the simulation conditions of the first computer simulation.

FIG. 9 shows that the eleventh model has lower tensile stress than the twelfth model. Thus, the fourth computer simulation shows that the gap portion Sp is preferably disposed near the lower end of the through hole H and that the stress may increase further than in the case where the gap portion Sp is not disposed if the gap portion Sp is disposed near the upper end portion of the through hole H.

Then, the inventors of the application conducted a fifth computer simulation. The inventors of the application created 13th to 17th models in the fifth computer simulation. The 13th to 16th models have a structure illustrated in FIG. 8. The 17th model has a configuration that does not include the low expansion portion 80 and in which the coefficient X2 of linear expansion of the insulating layers 26*a* to 26*e* is equal to the coefficient of linear expansion of a portion corresponding to the low expansion portion. The coefficient X5 of linear expansion of the low expansion portion 80 in the 13th model is approximately $12\times10^{-6}/°$ C. The coefficient X5 of linear expansion of the low expansion portion 80 in the 14th model is approximately $18\times10^{-6}/°$ C. The coefficient X5 of linear expansion of the low expansion portion 80 in the 15th model is approximately $24\times10^{-6}/°$ C. The coefficient X5 of linear expansion of the low expansion portion 80 in the 16th model is approximately $30\times10^{-6}/°$ C. The coefficient of linear expansion of the portion corresponding to the low expansion portion in the 17th model is approximately $36\times10^{-6}/°$ C. The coefficients X1 to X4 of linear expansion are the same as those used in the first computer simulation.

Figure 10:
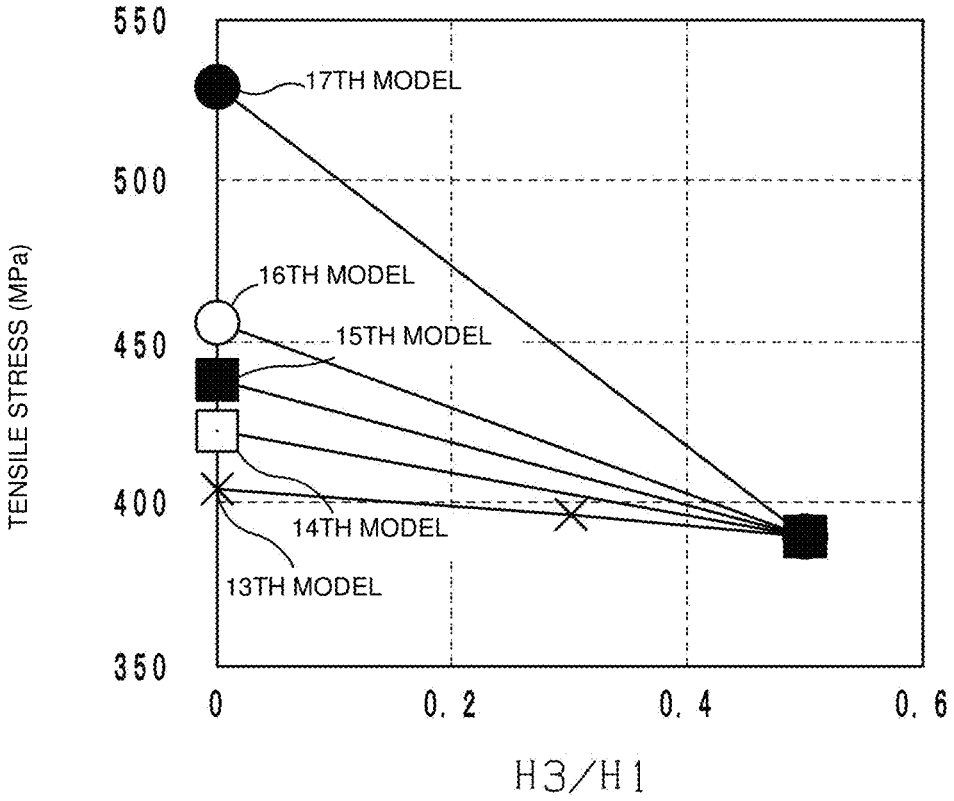
FIG. 10 is a graph showing the results of a fifth computer simulation.

The inventors of the application changed H3/H1 in the 13th to 17th models and caused a computer to calculate the stress. The calculated stress is the maximum stress caused at the point enclosed by circle D in FIG. 4. FIG. 10 is a graph showing the results of the fifth computer simulation. The vertical axis indicates the tensile stress and the horizontal axis indicates H3/H1.

The graph of FIG. 10 shows that the tensile stress decreases as the coefficient X5 of linear expansion of the low expansion portion 80 decreases. In other words, the graph shows that an occurrence of wire breakage in the inductors L1 and L2 is prevented further efficiently as the coefficient X5 of linear expansion of the low expansion portion 80 decreases.

The graph also shows that the tensile stress decreases as H3/H1 increases. Specifically, the graph shows that an occurrence of wire breakage in the inductors L1 and L2 is prevented further efficiently as the gap portion Sp increases. However, when H3/H1 is approximately 0.5, the 13th to 17th models had substantially the same tensile stress regardless of the coefficient X5 of linear expansion. Specifically, the tensile stress that occurs in the 13th to 16th models was substantially equal to the tensile stress that occurs in the 17th model. The 13th to 16th models each have the low expansion portion 80 and the gap portion Sp. In other words, the 13th to 16th models have the structure of the electronic component 10*a*. In the 17th model, on the other hand, the coefficient X5 of linear expansion is equal to the coefficient X2 of linear expansion. The 17th model has the gap portion Sp instead of the low expansion portion 80. In other words, the 17th model has a structure different from the structure of the electronic component 10*a*. Thus, the electronic component 10*a* exerts an effect of reducing the tensile stress attributable to the decrease of the coefficient X5 of linear expansion of the low expansion portion 80 when H3/H1 is less than approximately 0.5. Thus, H3/H1 is preferably less than 0.5 in the electronic component 10*a*.

When H3/H1 exceeds 0.5, the strength of the electronic component 10*a* may decrease or the inductor conductor layers 30*a*, 30*b*, 34*a*, and 34*b* may be distorted. Thus, H3/H1 is preferably less than 0.5. However, as is clear from the graph in FIG. 9, the tensile stress that occurs in the eleventh model when H3/H1 falls within the range of approximately 0.4 to 0.8 is smaller than the tensile stress that occurs in the eleventh model when H3/H1 is approximately 1.0. Specifically, from the stress reduction point of view, H3/H1 may fall within the range of approximately 0.4 to 0.8.

Second Modified Example

Figure 11:
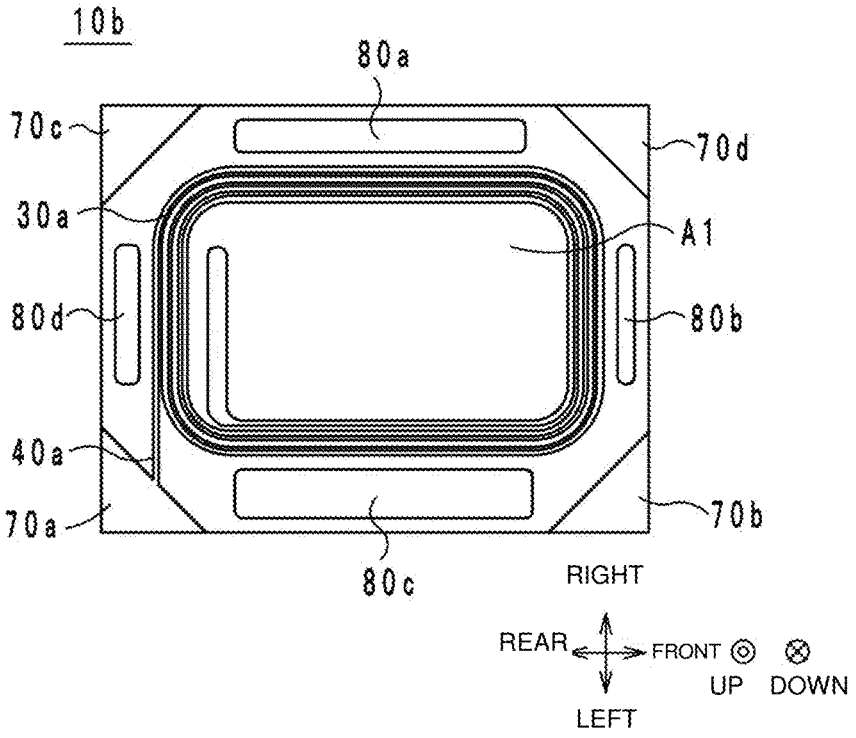
FIG. 11 is a perspective view of another electronic component viewed from above.

Referring now to the drawings, an electronic component 10*b* according to a second modified example is described. FIG. 11 is a perspective view of the electronic component 10*b* viewed from above. FIG. 11 illustrates an inductor conductor layer 30*a* and low expansion portions 80*a* to 80*d*.

The electronic component 10*b* is different from the electronic component 10 in that it includes the low expansion portions 80*a* to 80*d* instead of the low expansion portion 80. The electronic component 10*b* is described below mainly focusing on this difference.

The low expansion portions 80*a* to 80*d* are made of a material that is the same as the material of the low expansion portion 80 and have a coefficient X5 of linear expansion. The low expansion portions 80*a* to 80*d* are located on the outer sides of the inductor conductor layers 30*a*, 30*b*, 34*a*, and 34*b* (FIG. 11 only illustrates the inductor conductor layer 30*a*). The low expansion portions 80*a* to 80*d* extend through the insulating layers 26*a* to 26*e* in the vertical direction. When viewed from above, the low expansion portion 80*a* is located on the right side of the inductor conductor layers 30*a*, 30*b*, 34*a*, and 34*b*. When viewed from above, the low expansion portion 80*b* is located on the front side of the inductor conductor layers 30*a*, 30*b*, 34*a*, and 34*b*. When viewed from above, the low expansion portion 80*c* is located on the left side of the inductor conductor layers 30*a*, 30*b*, 34*a*, and 34*b*. When viewed from above, the low expansion portion 80*d* is located on the rear side of the inductor conductor layers 30*a*, 30*b*, 34*a*, and 34*b*. However, the low expansion portions 80*a* to 80*d* are not exposed to the outside from the front surface, the rear surface, the right surface, and the left surface of the laminated body 22.

Other components of the electronic component 10*b* are the same as those of the electronic component 10 and are thus not described.

Similarly to the electronic component 10, the electronic component 10*b* having the above-described configuration is capable of preventing an occurrence of wire breakage in the inductors L1 and L2. More specifically, the electronic component 10*b* includes the low expansion portions 80*a* to 80*d*, at least part of which is embedded in the laminated body 22. The coefficient x5 of linear expansion of the insulating resin from which the low expansion portions 80*a* to 80*d* are made is lower than the coefficient x2 of linear expansion of the insulating resin of the insulating layers 26*a* to 26*e*. In addition, the low expansion portions 80*a* to 80*d* are made of a material in which a silica filler is mixed into the insulating resin. Thus, the coefficient X5 of linear expansion of the low expansion portions 80*a* to 80*d* is lower than the coefficient x5 of linear expansion of the insulating resin. The coefficient X5 of linear expansion of the low expansion portions 80*a* to 80*d* is thus significantly lower than the coefficient X2 of linear expansion of the insulating layers 26*a* to 26*e*. Thus, when the electronic component 10*b* is heated, the low expansion portions 80*a* to 80*d* expand to a smaller extent than the extent to which the insulating layers 26*a* to 26*e* expand. The stress caused by the expansion of the insulating layers 26*a* to 26*e* is thus discharged toward the low expansion portions 80*a* to 80*d*. In this manner, the tensile stress exerted on the inductors L1 and L2 decreases, so that an occurrence of wire breakage in the inductors L1 and L2 is prevented.

The electronic component 10*b* is also capable of more effectively preventing an occurrence of wire breakage on the outer periphery of the inductors L1 and L2 for the reason described below. More specifically, in the electronic component 10*b*, the presence of the low expansion portions 80*a* to 80*d* prevents the portions of the insulating layers 26*a* to 26*e* located adjacent to the low expansion portions 80*a* to 80*d* from expanding to a larger extent than portions of the insulating layers 26*a* to 26*e* located further away from the low expansion portions 80*a* to 80*d*. Thus, in view of preventing an occurrence of wire breakage in the inductors L1 and L2, it is preferable that the inductors L1 and L2 be located adjacent to the low expansion portions 80*a* to 80*d*.

Thus, the inductor conductor layers 30*a*, 30*b*, 34*a*, and 34*b* each form a substantially spiral shape that winds clockwise, when viewed from above. The low expansion portion 80*a* is located on the right side of the inductor conductor layers 30*a*, 30*b*, 34*a*, and 34*b*, when viewed from above. The low expansion portion 80*b* is located on the front side of the inductor conductor layers 30*a*, 30*b*, 34*a*, and 34*b*, when viewed from above. The low expansion portion 80*c* is located on the left side of the inductor conductor layers 30*a*, 30*b*, 34*a*, and 34*b*, when viewed from above. The low expansion portion 80*d* is located on the rear side of the inductor conductor layers 30*a*, 30*b*, 34*a*, and 34*b*, when viewed from above. Thus, the low expansion portions 80*a* to 80*d* are located around the inductor conductor layers 30*a*, 30*b*, 34*a*, and 34*b*, when viewed from above. In other words, a large part of the inductor conductor layers 30*a*, 30*b*, 34*a*, and 34*b* is located adjacent to the low expansion portions 80*a* to 80*d*. This configuration thus more effectively prevents an occurrence of wire breakage in the inductors L1 and L2.

Third Modified Example

Figure 12:
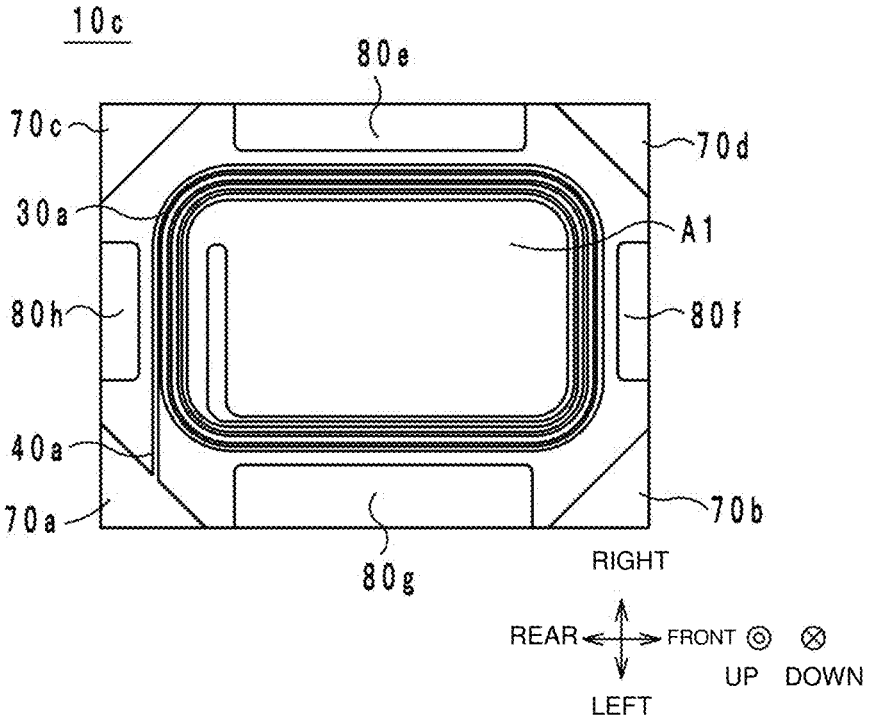
FIG. 12 is a perspective view of another electronic component viewed from above.

An electronic component 10*c* according to a third modified example is described below with reference to the drawings. FIG. 12 is a perspective view of the electronic component 10*c* viewed from above. FIG. 12 illustrates an inductor conductor layer 30*a* and low expansion portions 80*e* to 80*h*.

The electronic component 10*c* is different from the electronic component 10*b* in that it includes low expansion portions 80*e* to 80*h* instead of the low expansion portions 80*a* to 80*d*. The electronic component 10*c* is described below mainly focusing on this difference.

The low expansion portions 80*e* to 80*h* are made of a material the same as the material of the low expansion portion 80. The low expansion portions 80*e* to 80*h* have a coefficient X5 of linear expansion. The low expansion portions 80*e* to 80*h* are located on the outer sides of the inductor conductor layers 30*a*, 30*b*, 34*a*, and 34*b* (FIG. 12 only illustrates the inductor conductor layer 30*a*). The low expansion portions 80*e* to 80*h* extend through the insulating layers 26*a* to 26*e* in the vertical direction. When viewed from above, the low expansion portion 80*e* is located on the right side of the inductor conductor layers 30*a*, 30*b*, 34*a*, and 34*b*. When viewed from above, the low expansion portion 80*f* is located on the front side of the inductor conductor layers 30*a*, 30*b*, 34*a*, and 34*b*. When viewed from above, the low expansion portion 80*g* is located on the left side of the inductor conductor layers 30*a*, 30*b*, 34*a*, and 34*b*. When viewed from above, the low expansion portion 80*h* is located on the rear side of the inductor conductor layers 30*a*, 30*b*, 34*a*, and 34*b*. Here, the low expansion portions 80*e* to 80*h* are exposed from the right surface, the front surface, the left surface, and the rear surface of the laminated body 22.

Other components of the electronic component 10*c* are the same as those of the electronic component 10*b* and are thus not described here.

The electronic component 10*c* having the above configuration is capable of exerting the same effect as the electronic component 10*b*.

Fourth Modified Example

Figure 13:
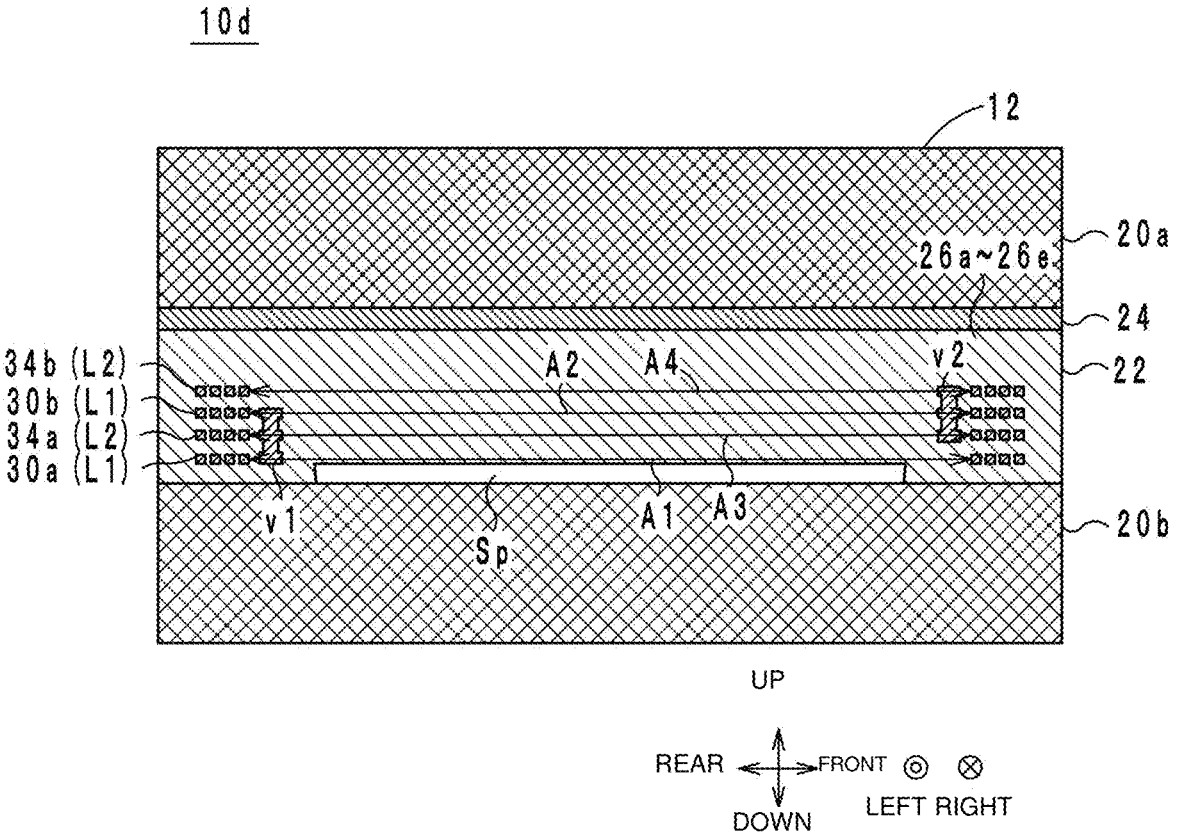
FIG. 13 is a sectional view of the structure of another electronic component.

The configuration of an electronic component 10*d* according to a fourth modified example is described with reference to the drawings. FIG. 13 is a sectional view of the structure of the electronic component 10*d*. The external perspective view of the electronic component 10*d* is the same as the external perspective view of the electronic component 10 and FIG. 1 is thus referred below. FIG. 13 is a sectional view of the structure taken along line 1-1 of FIG. 1.

The electronic component 10*d* is different from the electronic component 10*a* in that it does not include the low expansion portion 80. The electronic component 10*d* is described below mainly focusing on this difference.

In the electronic component 10*d*, the gap portion Sp is disposed in the laminated body 22 at a position inside the areas A1 to A4, when viewed from above, and adjoins the magnetic substrate 20*b*. Here, instead of the low expansion portion 80, the insulating layers 26*a* to 26*e* are disposed above the gap portion Sp.

Other components of the electronic component 10*d* are the same as those of the electronic component 10*a* and thus are not described here.

Similarly to the electronic component 10*a*, the electronic component 10*d* having the above-described configuration also prevents an occurrence of wire breakage in the inductors L1 and L2. More specifically, the gap portion Sp contains purely air. The gap portion Sp thus hardly ever expands when the electronic component 10*a* is heated. On the other hand, the insulating layers around the gap portion Sp expand and compress the gap portion Sp. The gap portion Sp thus allows the insulating layers to be freely deformed, so that the tensile stress caused in the insulating layers around the gap portion Sp decreases. Consequently, the electronic component 10*d* reduces the tensile stress exerted on the inductors L1 and L2 and prevents an occurrence of wire breakage in the inductors L1 and L2.

Here, the 17th model has a structure of the electronic component 10*d*. FIG. 10 shows that the 17th model also reduces the tensile stress with the presence of the gap portion Sp. FIG. 10 also shows that the 17th model reduces the tensile stress with an increase of H3/H1.

From the stress reduction point of view, we have described that H3/H1 may fall within the range of approximately 0.4 to 0.8, as is clear from the graph of FIG. 9, in the eleventh model including the low expansion portion 80. Presumably, the electronic component 10*d* that does not include the low expansion portion 80 also has the same characteristics as the eleventh model. Thus, from the stress reduction point of view, it is preferable in the electronic component 10*d* that H3/H1 fall within the range of approximately 0.4 to 0.8. When H3/H1 exceeds 0.5, the strength of the electronic component 10*d* may decrease or the inductor conductor layers 30*a*, 30*b*, 34*a*, and 34*b* may be distorted. Thus, H3/H1 is preferably less than 0.5.

Similarly to the electronic component 10*a*, the electronic component 10*d* is also capable of preventing an occurrence of wire breakage in the inductors L1 and L2 for the reason described below. More specifically, in the electronic component 10*d*, the bonding layer 24 adjoins the top surface of the laminated body 22. The bonding layer 24 has a coefficient X3 of linear expansion, which is relatively large. Thus, the bonding layer 24 reduces the stress at a portion adjacent to the top surface of the laminated body 22. On the other hand, the magnetic substrate 20*b* adjoins the undersurface of the laminated body 22. The magnetic substrate 20*b* has a coefficient X1 of linear expansion, which is relatively small. Thus, the stress is less likely to decrease at a portion adjacent to the undersurface of the laminated body 22. Thus, in the electronic component 10*d*, the gap portion Sp is disposed so as to adjoin the magnetic substrate 20*b*. This configuration allows reduction of the stress that occurs in the insulating layers at a portion adjacent to the undersurface of the laminated body 22. This configuration is thus capable of preventing an occurrence of wire breakage in the inductors L1 and L2.

Fifth Modified Example

Figure 14:
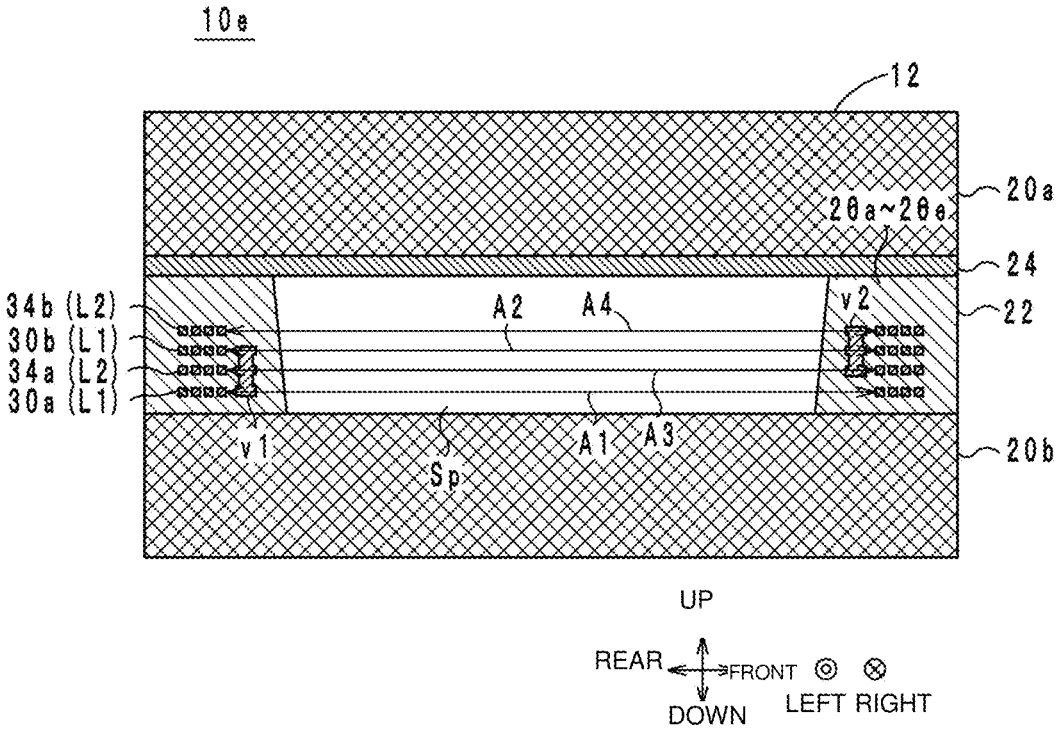
FIG. 14 is a sectional view of the structure of another electronic component.
Figure 15:
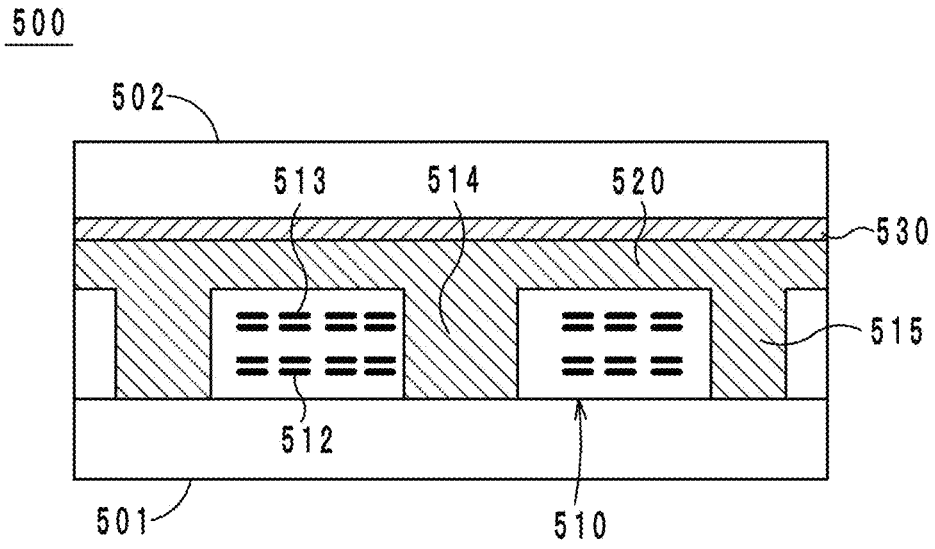
FIG. 15 is a sectional view of the structure of a coil component described in Japanese Unexamined Patent Application Publication No. 2003-133135.

The configuration of an electronic component 10*e* according to a fifth modified example is described below with reference to the drawings. FIG. 14 is a sectional view of the structure of the electronic component 10*e*. The external perspective view of the electronic component 10*e* is the same as the external perspective view of the electronic component 10 and FIG. 1 is thus referred below. FIG. 14 is a sectional view of the structure taken along line 1-1 of FIG. 1.

The electronic component 10*e* is different from the electronic component 10*d* in terms of the structure of the gap portion Sp. The electronic component 10*e* is described below mainly focusing on this difference.

In the electronic component 10*e*, the gap portion Sp extends in the vertical direction so as to adjoin the bonding layer 24 and the magnetic substrate 20*b*. Thus, the gap portion Sp extends through the areas A1 to A4 in the vertical direction.

Other components of the electronic component 10*e* are the same as those of the electronic component 10*d* and thus are not described here.

The electronic component 10*e* having the above-described configuration also prevents an occurrence of wire breakage in the inductors L1 and L2 for the same reason as in the case of the electronic component 10*d*.

Other Embodiments

Electronic components according to some embodiments of the disclosure are not limited to the electronic components 10 and 10*a* to 10*e* and can be modified within the scope of the gist of the disclosure.

The configurations of the electronic components 10 and 10*a* to 10*e* may be combined appropriately. Particularly, a combination of the low expansion portion 80 of the electronic component 10 and the low expansion portions 80*a* to 80*h* of the electronic components 10*b* and 10*c* is desirable from the point of view of reduction of stress that occurs on the inner side and the outer side of the inductors L1 and L2.

In the electronic component 10*d* or 10*e*, the gap portion Sp may be disposed on the outer side of the inductor conductor layers 30*a*, 30*b*, 34*a*, and 34*b*. Preferably, the gap portion Sp and the low expansion portion 80 are located adjacent to a portion at which a large stress occurs.

The inductor L1 is formed by connecting the substantially spiral inductor conductor layer 30*a* and the substantially spiral inductor conductor layer 30*b* together with the interlayer connection conductor v1 interposed therebetween. The configuration of the inductor L1, however, is not limited to this. The inductor L1 may form a substantially helical shape in which multiple inductor conductor layers each having a length corresponding to one turn are connected in series with the interlayer connection conductor interposed therebetween. Alternatively, the inductor L1 may be formed only of one inductor conductor layer without including the interlayer connection conductor. Alternatively, the inductor conductor layers 30*a* and 30*b* may have a shape of, for example, a substantially straight line, instead of a winding shape. Similarly to the inductor L1, the configuration of the inductor L2 is not limited to the one in which the substantially spiral inductor conductor layer 34*a* and the substantially spiral inductor conductor layer 34*b* are connected together with the interlayer connection conductor v2 interposed therebetween. Here, the substantially spiral shape is a two-dimensional curve and the substantially helical shape is a three-dimensional curve.

The inductors L1 and L2 do not have to form a common mode choke coil. In this case, the inductors L1 and L2 may form a transformer or a balun, or may be two inductors electrically connected in parallel.

Each of the low expansion portions 80 and 80*a* to 80*h* adjoins both magnetic substrates 20*a* and 20*b* or the magnetic substrate 20*a*, but does not have to adjoin both magnetic substrates 20*a* and 20*b*.

Instead of the magnetic substrates 20*a* and 20*b*, non-magnetic substrates may be disposed.

Although the low expansion portions 80 and 80*a* to 80*h* are described as being non-magnetic, they may be magnetic. When the low expansion portions 80 and 80*a* to 80*h* are non-magnetic, the low expansion portions 80 and 80*a* to 80*h* have a low eddy current loss, so that a high Q-value can be obtained also in a high frequency range. On the other hand, when the low expansion portions 80 and 80*a* to 80*h* are magnetic, the inductors L1 and L2 have high magnetic permeability, so that the inductors L1 and L2 have a high inductance value.

Each of the electronic components 10 and 10*a* to 10*d* includes two inductors L1 and L2. However, each of the electronic components 10 and 10*a* to 10*d* may include one inductor or three inductors or more. Each of the electronic components 10 and 10*a* to 10*d* may include a circuit element (such as a capacitor) other than an inductor.

Each of the electronic components 10 and 10*a* to 10*c* does not necessarily have to include the magnetic substrates 20*a* and 20*b* or the bonding layer 24. Each of the electronic components 10*d* and 10*e* does not necessarily have to include the magnetic substrate 20*a* or the bonding layer 24.

The inductor conductor layers 30*a*, 30*b*, 34*a*, and 34*b*, the exit conductor layers 40*a*, 40*b*, 44*a*, and 44*b*, the connection conductors 70*a* to 70*d*, and the interlayer connection conductors v1 and v2 may be formed by any of plating (subtractive, semi-additive, or full additive), deposition, and coating.

The inductor conductor layer 30*a* may be disposed on the top surface of the magnetic substrate 20*b* instead of the top surface of the insulating layer 26*e*.

In each of the electronic components 10 and 10*a* to 10*c*, the insulating resin (an example of the first resin) used as the material of the insulating layers 26*a* to 26*e* and the insulating resin (an example of the second resin) used as the material of the low expansion portion 80 may be the same. In this case, however, the low expansion portion 80 is magnetic. Specifically, the low expansion portion 80 is made of a material in which magnetic powder is mixed into an insulating resin the same as the insulating resin used as the material of the insulating layers 26*a* to 26*e*.

As described thus far, each embodiment of the present disclosure is useful as an electronic component and, particularly, efficient in prevention of an occurrence of wire breakage in an inductor.

While some embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. An electronic component comprising:

a body that includes a laminated body including a plurality of insulating layers laminated in a lamination direction, the insulating layers containing a first resin as a material;

a first inductor including a first inductor conductor layer that adjoins one of the insulating layers; and a low expansion portion having a coefficient of linear expansion lower than a coefficient of linear expansion of the plurality of insulating layers, the low expansion portion containing a second resin as a material, and at least part of the low expansion portion being embedded in the laminated body, wherein the second resin has a coefficient of linear expansion that is lower than a coefficient of linear expansion of the first resin, and the coefficient of linear expansion of the low expansion portion is lower than the coefficient of linear expansion of the second resin.

2. An electronic component comprising:

a body that includes a laminated body including a plurality of insulating layers laminated in a lamination direction, the insulating layers containing a first resin as a material;

a first inductor including a first inductor conductor layer that adjoins one of the insulating layers; and a low expansion portion having a coefficient of linear expansion lower than a coefficient of linear expansion of the plurality of insulating layers, the low expansion portion containing a second resin as a material, and at least part of the low expansion portion being embedded in the laminated body, wherein the low expansion portion is non-magnetic, and the coefficient of linear expansion of the low expansion portion is lower than a coefficient of linear expansion of the second resin.

3. The electronic component according to claim 1, wherein the plurality of insulating layers and the low expansion portion are non-magnetic.

4. The electronic component according to claim 1, wherein the first inductor winds in a predetermined direction when viewed in the lamination direction.

5. The electronic component according to claim 4, wherein the low expansion portion is located within an area surrounded by the first inductor.

6. The electronic component according to claim 4, further comprising:

a second inductor that includes a second inductor conductor layer that adjoins one of the insulating layers, wherein the second inductor winds in the predetermined direction when viewed in the lamination direction, and wherein an area surrounded by the first inductor overlaps an area surrounded by the second inductor when viewed in the lamination direction.

7. The electronic component according to claim 1, further comprising:

a second inductor that includes a second inductor conductor layer that adjoins one of the insulating layers, wherein the low expansion portion is located within an area surrounded by the second inductor when viewed in the lamination direction.

8. The electronic component according to claim 1, wherein the laminated body has a first main surface on a first side in the lamination direction, wherein the body further includes a first substrate that has a coefficient of linear expansion lower than the coefficient of linear expansion of the plurality of insulating layers, the first substrate adjoining the first main surface.

9. The electronic component according to claim 8, wherein the laminated body has a gap portion that overlaps the low expansion portion when viewed in the lamination direction and that adjoins the low expansion portion and the first substrate.

10. The electronic component according to claim 9, wherein a ratio of a height of the gap portion in the lamination direction to a height of the laminated body in the lamination direction falls within 0.4 to 0.8.

11. The electronic component according to claim 9, wherein a ratio of a height of the gap portion in the lamination direction to a height of the laminated body in the lamination direction is lower than 0.5.

12. The electronic component according to claim 8, wherein the laminated body further has a second main surface on a second side in the lamination direction, and wherein the body further includes a second substrate that has a coefficient of linear expansion lower than the coefficient of linear expansion of the plurality of insulating layers, and a bonding layer that has a coefficient of linear expansion higher than or equal to the coefficient of linear expansion of the low expansion portion, the bonding layer bonding the second substrate and the second main surface to each other.

13. The electronic component according to claim 12, wherein the laminated body has a through hole that extends through the laminated body in the lamination direction, and wherein the low expansion portion is disposed in the through hole so as to adjoin the first substrate and the bonding layer.

14. The electronic component according to claim 2, wherein the plurality of insulating layers and the low expansion portion are non-magnetic.

15. The electronic component according to claim 2, wherein the first inductor winds in a predetermined direction when viewed in the lamination direction.

16. The electronic component according to claim 15, wherein the low expansion portion is located within an area surrounded by the first inductor.

17. The electronic component according to claim 15, further comprising:

a second inductor that includes a second inductor conductor layer that adjoins one of the insulating layers, wherein the second inductor winds in the predetermined direction when viewed in the lamination direction, and wherein an area surrounded by the first inductor overlaps an area surrounded by the second inductor when viewed in the lamination direction.

18. The electronic component according to claim 2, further comprising:

a second inductor that includes a second inductor conductor layer that adjoins one of the insulating layers, wherein the low expansion portion is located within an area surrounded by the second inductor when viewed in the lamination direction.

19. The electronic component according to claim 2, wherein the laminated body has a first main surface on a first side in the lamination direction, wherein the body further includes a first substrate that has a coefficient of linear expansion lower than the coefficient of linear expansion of the plurality of insulating layers, the first substrate adjoining the first main surface.

20. The electronic component according to claim 19, wherein the laminated body has a gap portion that overlaps the low expansion portion when viewed in the lamination direction and that adjoins the low expansion portion and the first substrate.

21. The electronic component according to claim 20, wherein a ratio of a height of the gap portion in the lamination direction to a height of the laminated body in the lamination direction falls within 0.4 to 0.8.

22. The electronic component according to claim 20, wherein a ratio of a height of the gap portion in the lamination direction to a height of the laminated body in the lamination direction is lower than 0.5.

23. The electronic component according to claim 19, wherein the laminated body further has a second main surface on a second side in the lamination direction, and wherein the body further includes a second substrate that has a coefficient of linear expansion lower than the coefficient of linear expansion of the plurality of insulating layers, and a bonding layer that has a coefficient of linear expansion higher than or equal to the coefficient of linear expansion of the low expansion portion, the bonding layer bonding the second substrate and the second main surface to each other.

24. The electronic component according to claim 23, wherein the laminated body has a through hole that extends through the laminated body in the lamination direction, and wherein the low expansion portion is disposed in the through hole so as to adjoin the first substrate and the bonding layer.

* * * * *